US007980392B2

(12) United States Patent
Larson et al.

(10) Patent No.: US 7,980,392 B2
(45) Date of Patent: Jul. 19, 2011

(54) SHALE SHAKER SCREENS WITH ALIGNED WIRES

(75) Inventors: Thomas Robert Larson, Montgomery, TX (US); David Lee Schulte, Jr., Willis, TX (US)

(73) Assignee: Varco I/P, Houston, TX (US)

( * ) Notice: Subject to any disclaimer, the term of this patent is extended or adjusted under 35 U.S.C. 154(b) by 657 days.

(21) Appl. No.: 11/897,976

(22) Filed: Aug. 31, 2007

(65) Prior Publication Data

US 2009/0057206 A1 Mar. 5, 2009

(51) Int. Cl.
*B07B 1/49* (2006.01)

(52) U.S. Cl. ..... 209/392; 209/393; 209/395; 209/397; 209/400; 209/401

(58) Field of Classification Search ..... 209/379, 209/388, 397, 400–403
See application file for complete search history.

(56) References Cited

U.S. PATENT DOCUMENTS

| | | | | | |
|---|---|---|---|---|---|
| 399,616 | A | | 3/1889 | Hurford | 209/401 |
| 485,488 | A | | 11/1892 | Cockrell | 209/401 |
| 1,078,380 | A | | 11/1913 | Reynolds | |
| 1,139,469 | A | | 5/1915 | Potter | 209/401 |
| 1,304,918 | A | | 5/1919 | Sweetland | |
| 1,459,845 | A | | 6/1923 | Mitchell | |
| 1,830,792 | A | * | 11/1931 | Herrmann | 209/401 |
| 1,997,713 | A | | 4/1935 | Boehm | 298/401 |
| 2,082,513 | A | * | 6/1937 | Roberts | 210/490 |
| 2,112,784 | A | | 3/1938 | McNitt | 99/105 |
| 2,418,529 | A | | 4/1947 | Stern | 51/309 |
| 2,926,785 | A | | 3/1960 | Sander | |
| 2,973,865 | A | | 5/1961 | Cibula | 209/315 |
| 3,012,674 | A | * | 12/1961 | Hoppe | 209/401 |
| 3,302,720 | A | | 2/1967 | Brandon | 166/42 |
| 3,640,344 | A | | 2/1972 | Brandon | 166/307 |
| 3,716,138 | A | | 2/1973 | Lumsden | 209/401 |
| 3,796,299 | A | | 3/1974 | Musschoot | 198/220 |
| 3,855,380 | A | | 12/1974 | Gordon et al. | 264/97 |

(Continued)

FOREIGN PATENT DOCUMENTS

DE 4127929 A1 2/1993

(Continued)

OTHER PUBLICATIONS

Letter, John J. Bakula. Derrick Corporation, to Guy McClung. 1 p., Mar. 11, 2009.

(Continued)

*Primary Examiner* — Terrell H Matthews
(74) *Attorney, Agent, or Firm* — Williams, Morgan & Amerson, P.C.

(57) ABSTRACT

A screen for a vibratory separator, the screen including at least two layers of screening material, including a first layer and a second layer, the first layer made of a plurality of intersecting first wires, the second layer made of a plurality of intersecting second wires, the first wires including first shute wires and first warp wires, the second wires including second shute wires and second warp wires, certain of the first warp wires aligned with a second warp wire, and/or certain of the first shute wires aligned with a second shute wire. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 CFR 1.72(b).

17 Claims, 18 Drawing Sheets

U.S. PATENT DOCUMENTS 3,874,733 A 4/1975 Poundstone et al. ..... 299/17
3,900,393 A 8/1975 Wilson ..... 209/399
3,993,146 A 11/1976 Poundstone et al. ..... 175/206
4,033,865 A * 7/1977 Derrick, Jr. ..... 209/275
4,038,152 A 7/1977 Atkins ..... 201/2.5
4,222,988 A 9/1980 Barthel ..... 422/309
4,233,181 A 11/1980 Goller et al. ..... 252/425.3
4,380,494 A 4/1983 Wilson ..... 290/319
4,411,074 A 10/1983 Daly ..... 34/32
4,482,459 A 11/1984 Shiver ..... 210/639
4,491,517 A 1/1985 Janovac ..... 209/401
4,526,687 A 7/1985 Nugent ..... 210/202
4,575,336 A 3/1986 Mudd et al. ..... 432/72
4,575,421 A 3/1986 Derrick et al. ..... 298/397
4,624,417 A 11/1986 Gangi ..... 241/17
4,650,687 A 3/1987 Willard et al. ..... 426/438
4,691,744 A 9/1987 Haver et al. ..... 139/425 R
4,696,353 A 9/1987 Elmquist et al. ..... 175/206
4,696,751 A * 9/1987 Eifling ..... 210/780
4,729,548 A 3/1988 Sullins ..... 266/44
4,751,887 A 6/1988 Terry et al. ..... 110/246
4,770,711 A 9/1988 Deal, III et al. ..... 134/18
4,783,057 A 11/1988 Sullins ..... 266/44
4,791,002 A 12/1988 Baker et al. ..... 426/641
4,799,987 A 1/1989 Sullins ..... 156/425
4,809,791 A 3/1989 Hayatdavoudi ..... 175/40
4,832,853 A 5/1989 Shiraki et al. ..... 210/781
4,857,176 A 8/1989 Derrick et al. ..... 209/392
4,889,733 A 12/1989 Willard et al. ..... 426/438
4,889,737 A 12/1989 Willard et al. ..... 426/550
4,895,665 A 1/1990 Colelli et al. ..... 210/710
4,895,731 A 1/1990 Baker et al. ..... 426/641
4,896,835 A 1/1990 Fahrenholz ..... 241/74
4,915,452 A 4/1990 Dibble ..... 299/17
4,942,929 A 7/1990 Malachosky et al. ..... 175/66
5,053,082 A 10/1991 Flanigan et al. ..... 134/25.1
5,066,350 A 11/1991 Sullins ..... 156/187
5,080,721 A 1/1992 Flanigan et al. ..... 134/26
5,107,874 A 4/1992 Flanigan et al. ..... 134/60
5,109,933 A 5/1992 Jackson ..... 175/66
5,129,469 A 7/1992 Jackson ..... 175/66
5,145,256 A 9/1992 Wiemers et al. ..... 366/336
5,181,578 A 1/1993 Lawler ..... 175/424
5,190,645 A 3/1993 Burgess ..... 210/144
5,200,372 A 4/1993 Kuroyama et al. ..... 501/96
5,221,008 A * 6/1993 Derrick et al. ..... 209/269
5,227,057 A 7/1993 Lundquist ..... 210/174
5,253,718 A 10/1993 Lawler ..... 175/20
5,256,291 A 10/1993 Cagle ..... 210/499
5,314,058 A 5/1994 Graham ..... 198/753
5,330,057 A 7/1994 Schiller et al. ..... 209/392
5,332,101 A 7/1994 Bakula ..... 209/403
5,337,966 A 8/1994 Francis et al. ..... 241/46.06
5,370,797 A 12/1994 Cagle ..... 210/499
5,385,669 A 1/1995 Leone, Sr. ..... 210/488
5,417,793 A 5/1995 Bakula ..... 156/308.2
5,417,858 A 5/1995 Derrick et al. ..... 210/388
5,417,859 A 5/1995 Bakula ..... 210/ 388
5,488,104 A 1/1996 Schulz ..... 536/86
5,489,204 A 2/1996 Conwell et al. ..... 432/153
5,516,348 A 5/1996 Conwell et al. ..... 51/309
5,534,207 A 7/1996 Burrus ..... 264/150
5,547,479 A 8/1996 Conwell et al. ..... 51/309
5,566,889 A 10/1996 Preiss ..... 241/19
5,567,150 A 10/1996 Conwell et al. ..... 432/14
5,570,749 A 11/1996 Reed ..... 175/66
5,626,234 A 5/1997 Cook et al. ..... 209/315
5,636,749 A 6/1997 Wojciechowski ..... 209/403
5,669,941 A 9/1997 Peterson ..... 51/295
5,720,881 A 2/1998 Derrick et al. ..... 210/388
5,732,828 A 3/1998 Littlefield, Jr. ..... 209/365.1
5,783,077 A 7/1998 Bakula ..... 210/388
5,791,494 A 8/1998 Meyer ..... 209/368
5,814,218 A 9/1998 Cagle ..... 210/388
5,819,952 A * 10/1998 Cook et al. ..... 209/400
5,868,125 A 2/1999 Maoujoud ..... 125/15
5,868,929 A 2/1999 Derrick et al. ..... 210/388
5,876,552 A 3/1999 Bakula ..... 156/308
5,896,998 A 4/1999 Bjorklund et al. ..... 209/326
5,944,197 A * 8/1999 Baltzer et al. ..... 209/400
5,944,993 A 8/1999 Derrick et al. ..... 210/388
5,958,236 A 9/1999 Bakula ..... 210/388
5,971,307 A 10/1999 Davenport ..... 241/259.1
6,000,556 A 12/1999 Bakula ..... 210/388
6,013,158 A 1/2000 Wootten ..... 202/99
6,032,806 A 3/2000 Leone et al. ..... 209/402
6,045,070 A 4/2000 Davenport ..... 241/60
6,053,332 A 4/2000 Bakula ..... 210/388
6,102,310 A 8/2000 Davenport ..... 241/21
6,138,834 A 10/2000 Southall ..... 209/17
6,155,428 A 12/2000 Bailey et al. ..... 209/315
6,161,700 A * 12/2000 Bakula ..... 209/401
6,170,580 B1 1/2001 Reddoch ..... 175/66
6,220,448 B1 4/2001 Bakula et al. ..... 209/392
6,220,449 B1 4/2001 Schulte, Jr. et al. ..... 209/401
6,223,906 B1 5/2001 Williams ..... 210/400
6,234,250 B1 5/2001 Green et al. ..... 166/250.03
6,237,780 B1 5/2001 Schulte ..... 210/388
6,279,471 B1 8/2001 Reddoch ..... 100/37
6,283,302 B1 9/2001 Schulte et al. ..... 209/399
6,333,700 B1 12/2001 Thomeer et al. ..... 340/854.8
6,371,306 B2 4/2002 Adams et al. ..... 320/388
6,431,368 B1 8/2002 Carr ..... 209/403
6,506,310 B2 1/2003 Kulbeth ..... 210/780
6,510,947 B1 * 1/2003 Schulte et al. ..... 210/388
6,601,709 B2 8/2003 Schulte, Jr. et al. ..... 209/397
6,669,027 B1 12/2003 Mooney et al. ..... 209/405
6,692,599 B2 2/2004 Cook et al. ..... 156/94
6,763,605 B2 7/2004 Reddoch ..... 34/58
6,783,088 B1 8/2004 Gillis et al. ..... 241/19
6,793,814 B2 9/2004 Fout et al. ..... 210/188
6,825,136 B2 11/2004 Cook et al. ..... 442/6
7,195,084 B2 3/2007 Burnett et al. ..... 175/66
7,284,665 B2 10/2007 Fuchs ..... 209/270
7,303,079 B2 12/2007 Reid-Robertson et al. ... 209/405
7,316,321 B2 * 1/2008 Robertson et al. ..... 209/400
7,373,996 B1 5/2008 Martin et al. ..... 175/206
7,514,011 B2 4/2009 Kulbeth ..... 210/780
7,581,569 B2 * 9/2009 Beck ..... 139/425 R
7,770,665 B2 8/2010 Eia et al. ..... 175/66
2001/0032815 A1 * 10/2001 Adams et al. ..... 210/388
2002/0000399 A1 1/2002 Winkler et al. ..... 209/399
2002/0033278 A1 3/2002 Reddoch ..... 175/57
2002/0134709 A1 * 9/2002 Riddle ..... 209/238
2004/0040746 A1 3/2004 Niedermayr et al. ..... 175/38
2004/0051650 A1 3/2004 Gonsoulin et al. ..... 340/853.1
2004/0156920 A1 8/2004 Kane ..... 424/725
2004/0245155 A1 12/2004 Strong et al. ..... 209/405
2005/0236305 A1 10/2005 Schulte, Jr. et al. ..... 209/403
2006/0034988 A1 2/2006 Bresnahan et al. ..... 426/502
2008/0078704 A1 4/2008 Carr et al. ..... 209/399
2008/0179090 A1 7/2008 Eia et al. ..... 175/5
2008/0179096 A1 7/2008 Eia et al. ..... 175/66
2008/0179097 A1 7/2008 Eia et al. ..... 175/66
2009/0286098 A1 11/2009 Yajima et al. ..... 428/507
2009/0316084 A1 12/2009 Yajima et al. ..... 349/96
2010/0084190 A1 4/2010 Eia et al. ..... 175/5
2010/0119570 A1 5/2010 Potter et al. ..... 424/422

FOREIGN PATENT DOCUMENTS

FR 2 611 559 9/1988
FR 2 636 669 3/1990
GB 2 030 482 A 4/1980
GB 2 327 442 A 1/1999
JP 55112761 8/1980
JP 59069268 4/1984
JP 63003090 1/1988
JP 63283860 11/1988
JP 63290705 11/1988
JP 02127030 5/1990
JP 02167834 6/1990
JP 03240925 10/1991
JP 03264263 11/1991
JP 04093045 3/1992
JP 04269170 9/1992
JP 05043884 2/1993
JP 05301158 11/1993

| | | |
|---|---|---|
| JP | 06063499 | 3/1994 |
| JP | 07304028 | 11/1995 |
| JP | 08039428 | 2/1996 |
| JP | 08270355 | 10/1996 |
| JP | 09109032 | 4/1997 |
| WO | WO98/10895 | 3/1998 |

OTHER PUBLICATIONS

"Innovation by Design—Screen Surfaces & Accessories," Derrick Corporation, Front Cover, pages numbered 2-14, Back Cover, undated.
Composite Catalog A Complete Line of Solids Control Equipment, Derrick Equipment Company, 28 pges. 2006.
Derrick Pyramid Screens, Derrick Corporation. 4 pages, 1994.
Composite Catalog A Complete Line of Solids Control Equipment. Derrick Equipment Company, 20 pages, 2002.
Layered shale shaker screens improve mud solids control, Cagle et al. Derrick Equipment Co., 7 pages, 1978.
An Innovative Method of Ranking Shale Shaker Screens, Morrison, Derrick Equipment Company, 4 pages, 1991.
Principles of High Speed Screening and Screen Machine Design, Derrick Manufacturing Corporation. 4 pages, 1981.
Derrick Screens, Derrick Manufacturing Corporation, 9 pages, 1992.
Handbook of Replacement Screen Surfaces and Accessories for Vibrating Motor Derrick Screening Machines High Speed Screening Machines, Derrick Manufacturing Corporation, 12 pages 1993.
Derrick Pyramid Screens, Derrick Equipment Company, 2 pages, 1993.
PCT/GB2008/050754 International Search Report (Sep. 17, 2009).
U.S. Appl. No. 12/481,959 Final Office Action dated Oct. 27, 2010.
U.S. Appl. No. 12/481,959 Office Action dated Jun. 7, 2010.
U.S. Appl. No. 12/469,851 Final Office Action dated Nov. 9, 2010.
U.S. Appl. No. 12/469,851 Office Action dated Jun. 28, 2010.
U.S. Appl. No. 12/227,462 Office Action dated Nov. 15, 2010.
U.S. Appl. No. 11/897,975 Final Office Action dated Jul. 21, 2010.
U.S. Appl. No. 11/897,975 Office Action dated Feb. 19, 2010.
U.S. Appl. No. 11/637,615 Final Office Action dated Aug. 2, 2010.
U.S. Appl. No. 11/637,615 Office Action dated Mar. 2, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.

* cited by examiner d
j
10
e
k
11
f
l
12

12
10
11

13
13
13
m
n
14
14
o
15

16
p
17
q
18
r

FIG. 3H
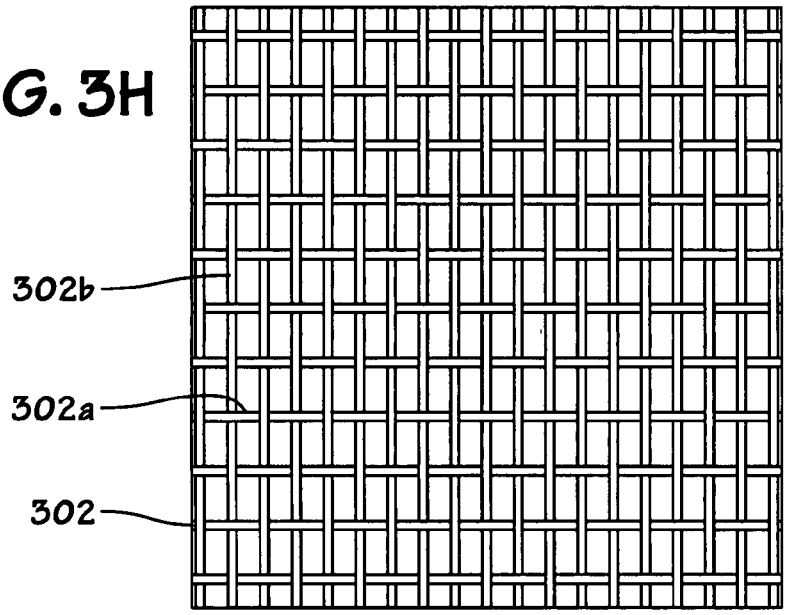
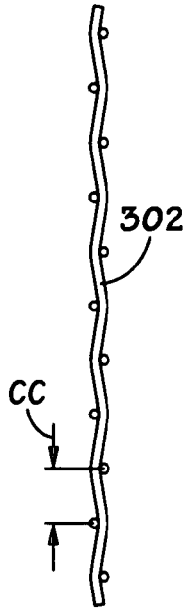
FIG. 3J
FIG. 3I
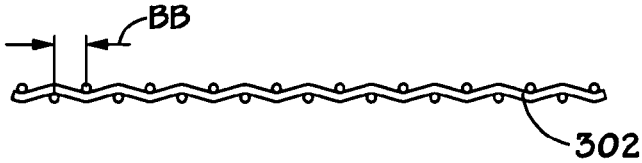
FIG. 3K
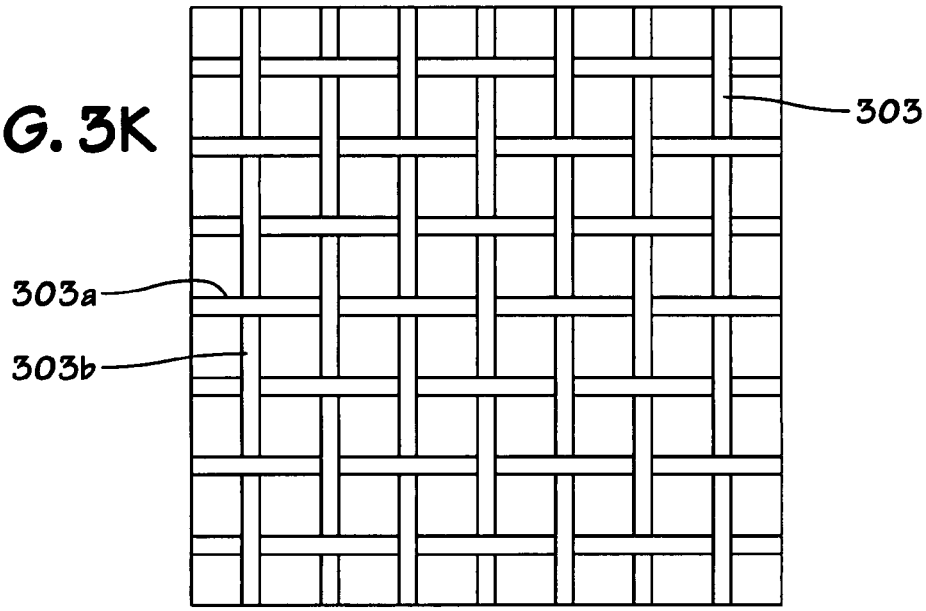
FIG. 3L
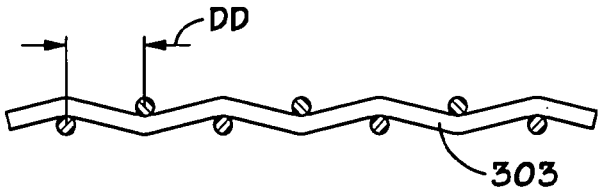

FIG. 4H
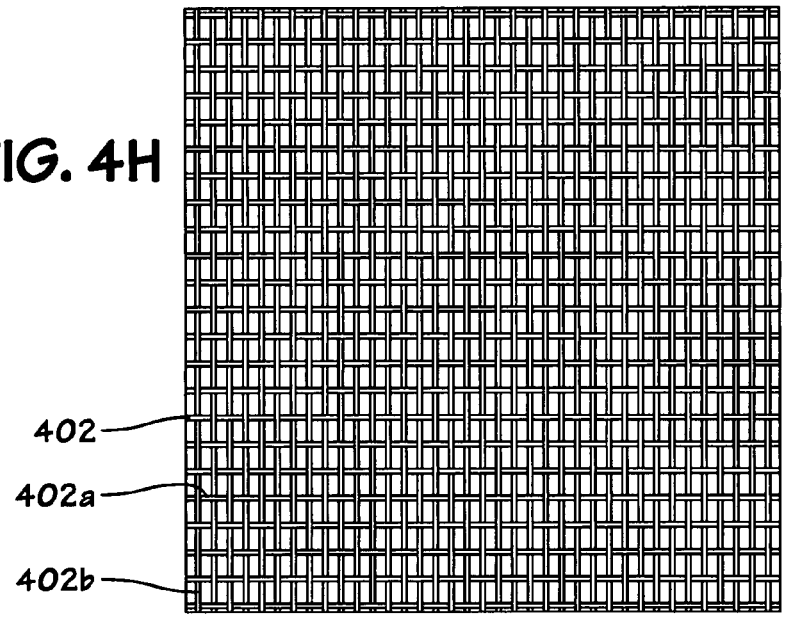
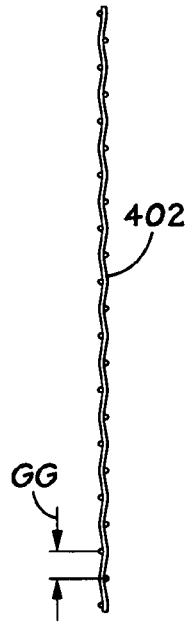
FIG. 4J
FIG. 4I
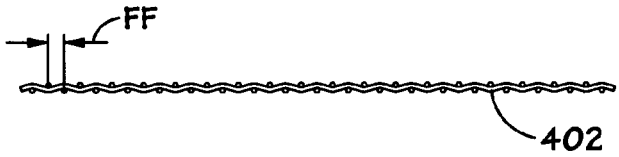
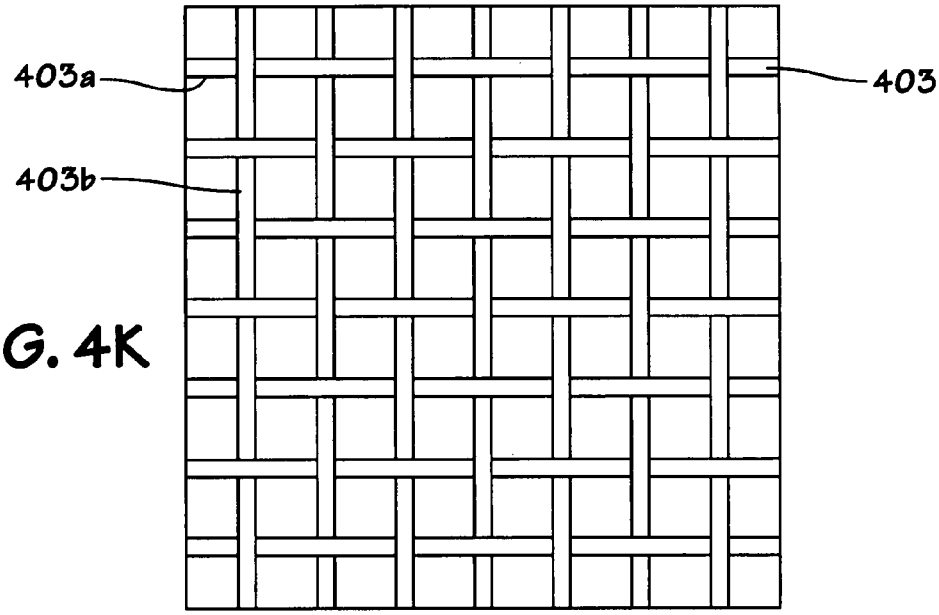
FIG. 4K
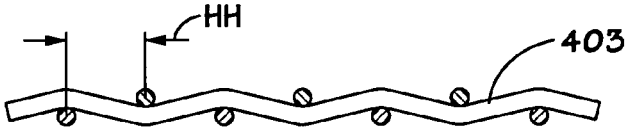
FIG. 4L FIG. 5A
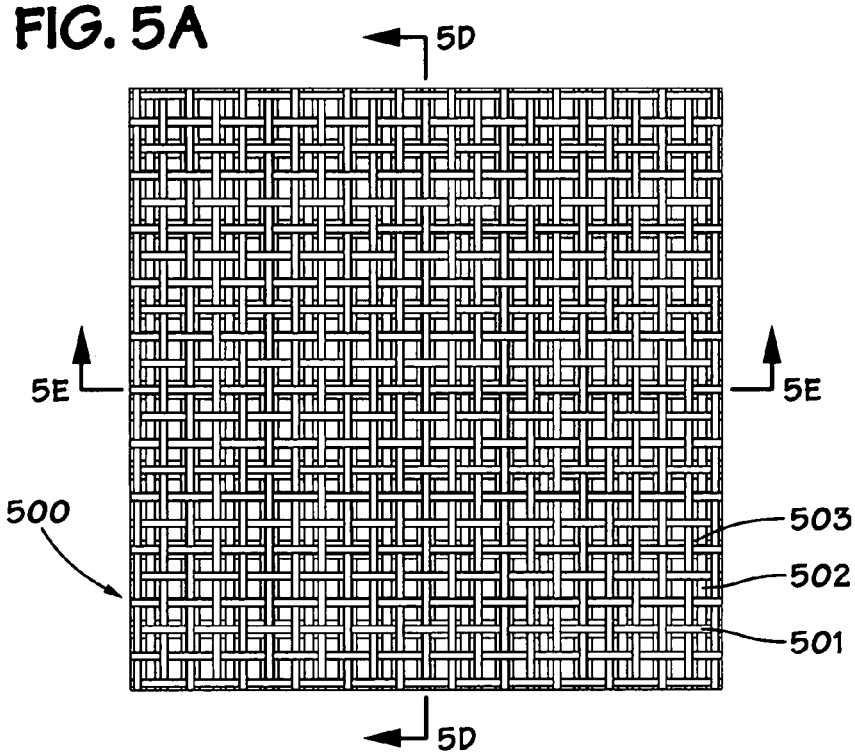
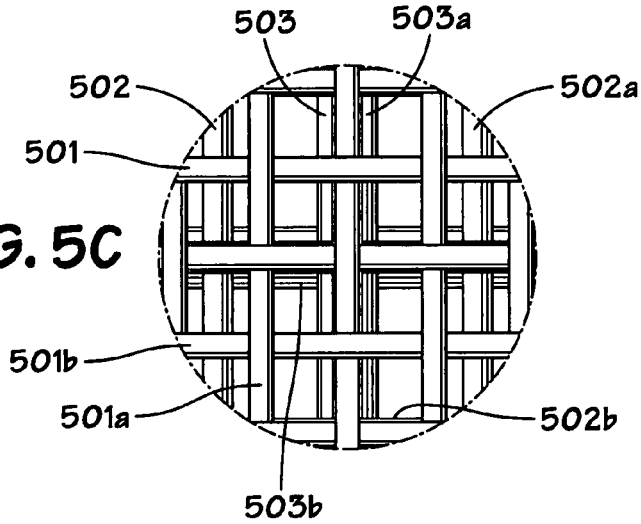
FIG. 5C
FIG. 5E
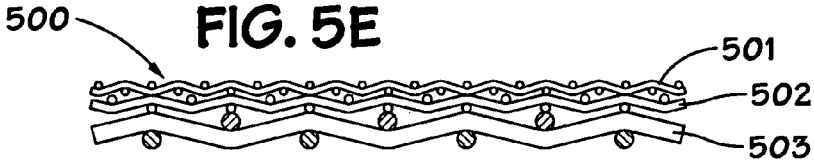
FIG. 5D
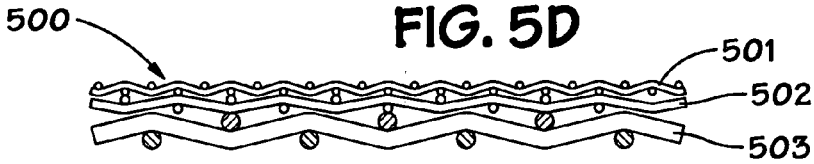

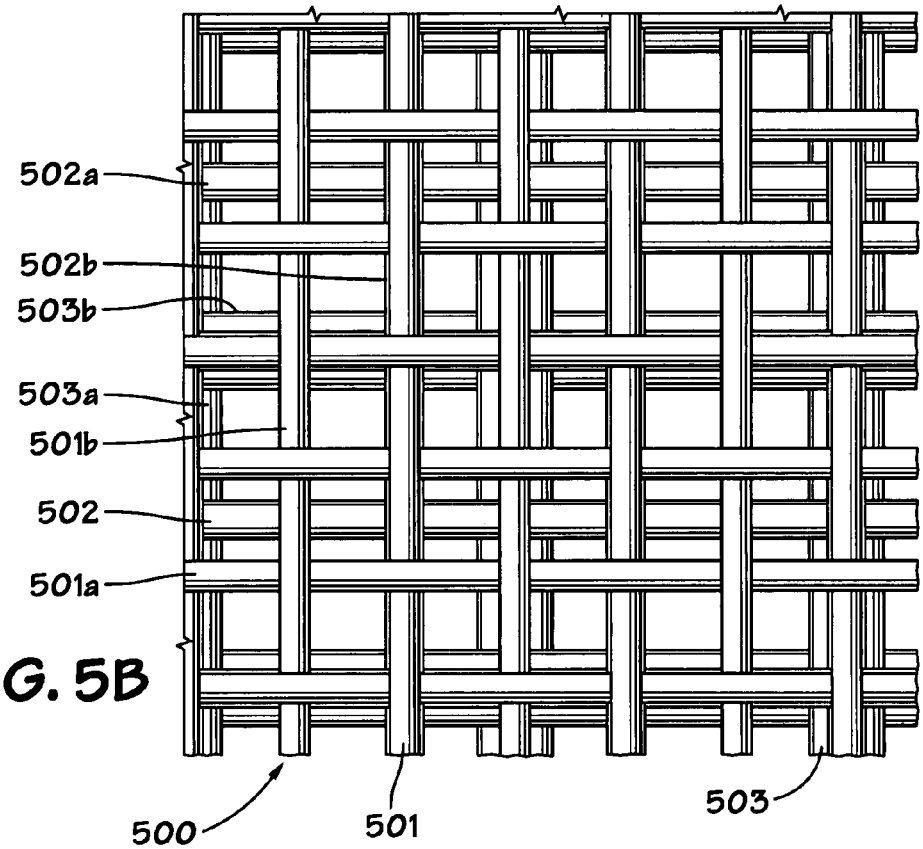
FIG. 5B
FIG. 5F
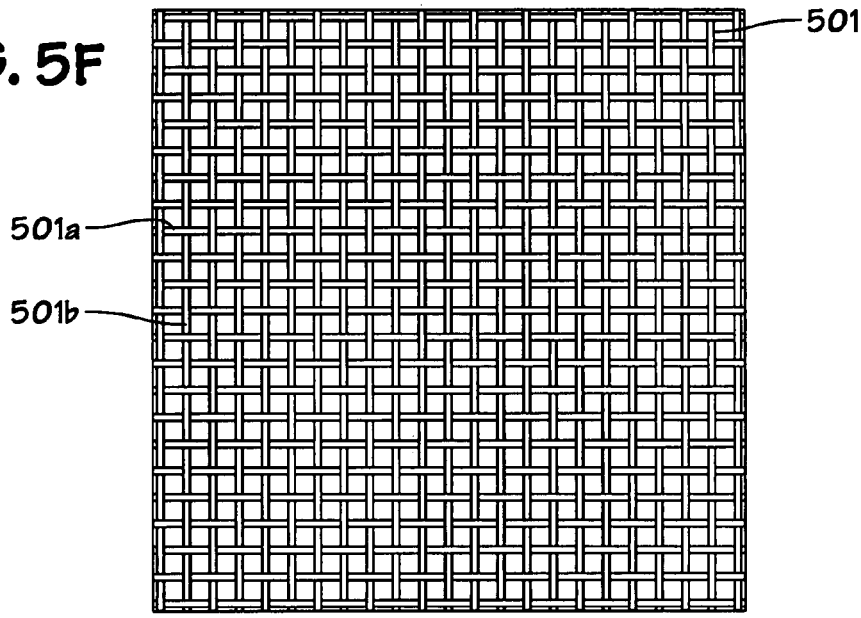
FIG. 5G
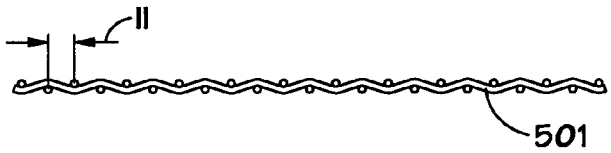

FIG. 5H
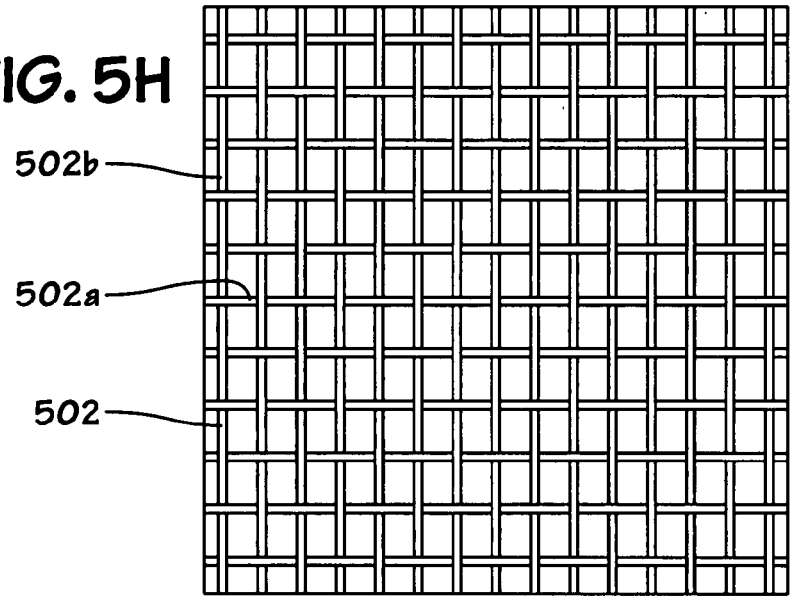
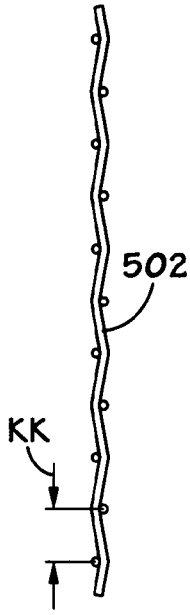
FIG. 5J
FIG. 5I
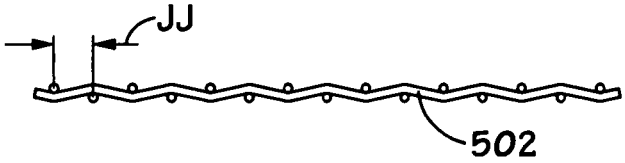
FIG. 5K
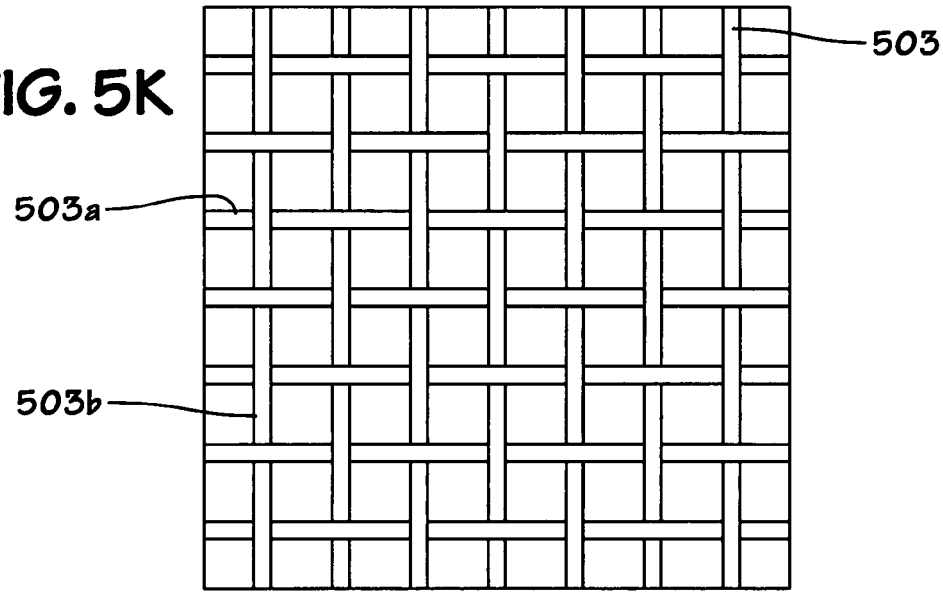
FIG. 5L
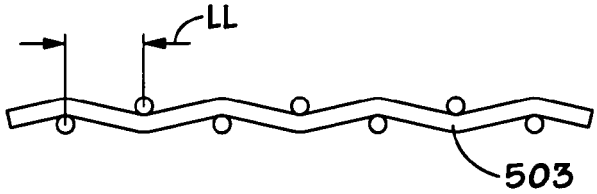

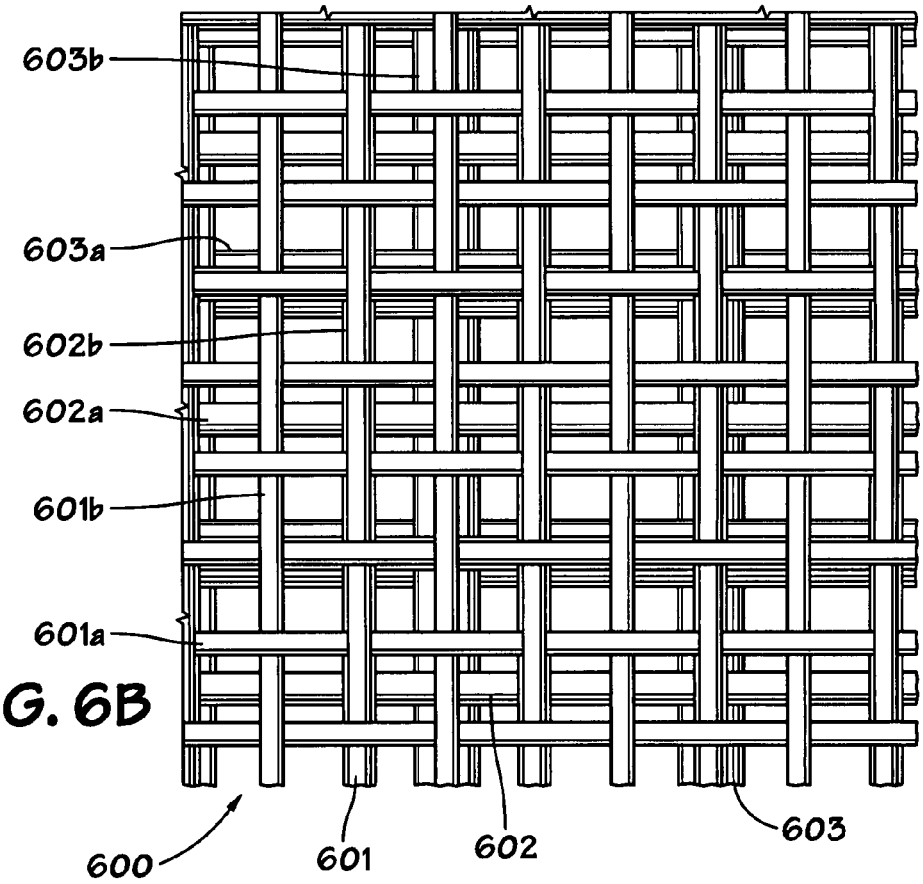
FIG. 6B
FIG. 6F
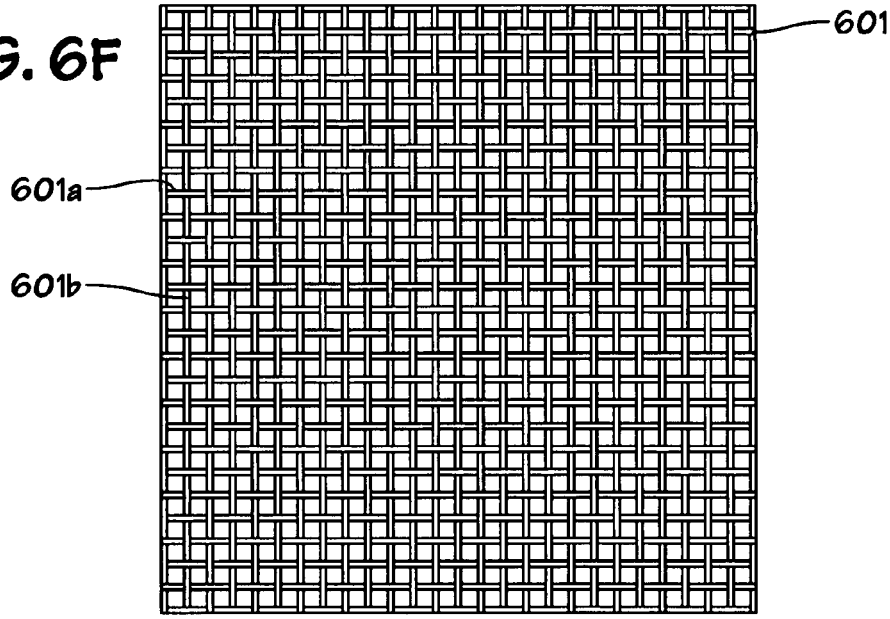
FIG. 6G
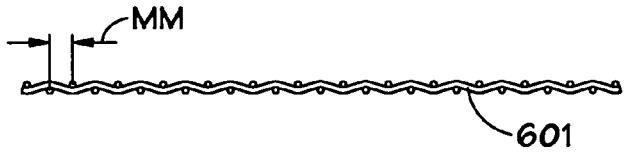

FIG. 6H
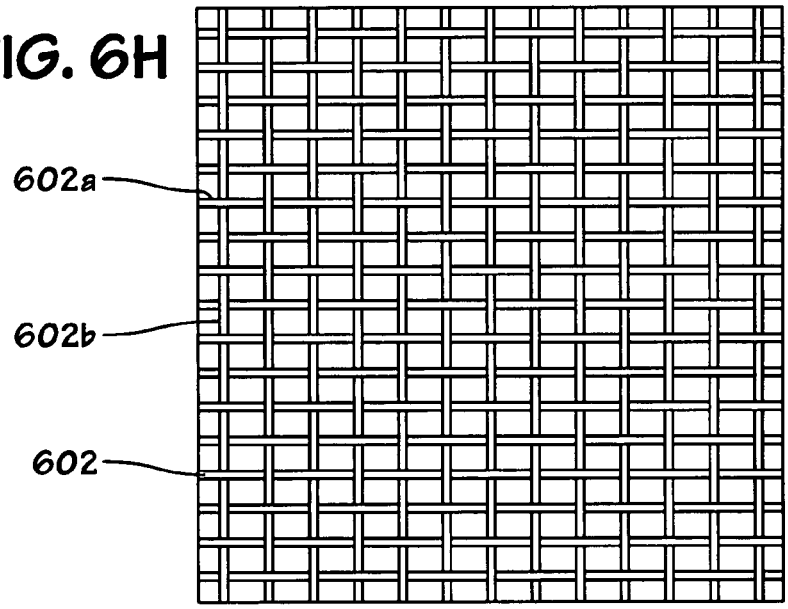
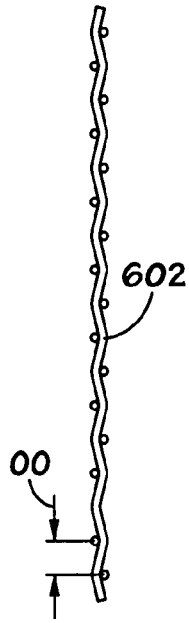
FIG. 6J
FIG. 6I
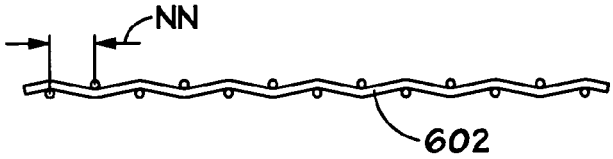
FIG. 6K
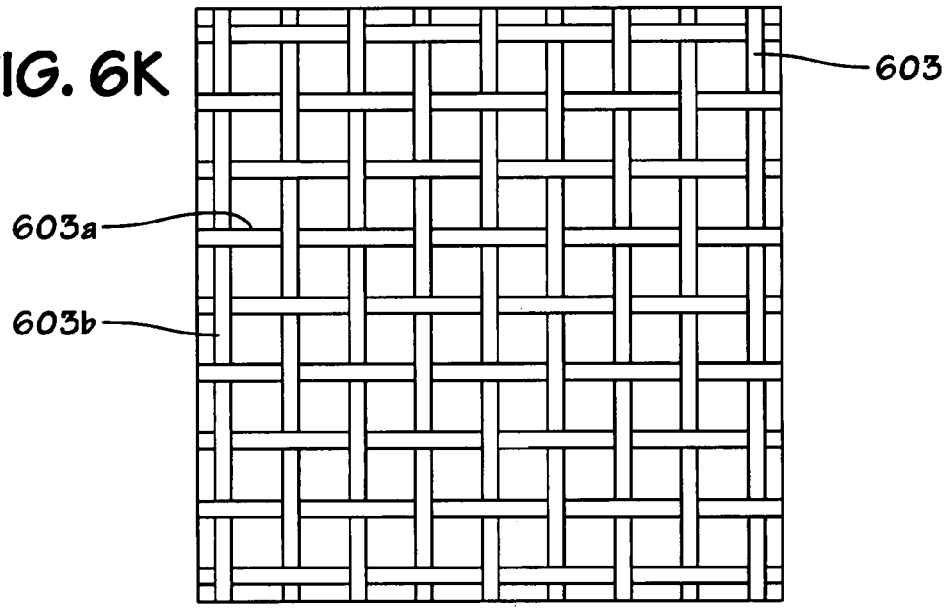
FIG. 6L
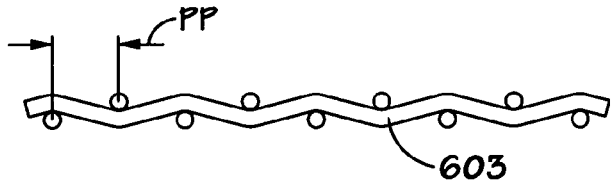

FIG. 8

| Range | | | | Description |
|---|---|---|---|---|
| 25 | to | 500 | 1 | Top Warp Openings in Microns |
| 0.1 | to | 1.1 | 2 | Wire Diameter Multiplier |
| | | | | 2a: Limitation on Fine End |
| | | | 3 | Top Cloth Specification |
| 0.25 | to | 4.00 | | 3a: Aspect Ratio: |
| 5 | to | 45 | | 3b: Top Warp Theoretical Angle (degrees) |
| 0.1 | to | 10 | 4 | Top Warp to Middle Warp COUNT Ratios |
| 1 | to | 10 | | 4a: The numerator in the Top Warp to Middle Warp COUNT Ratio is an integer |
| 1 | to | 10 | | 4b: The denominator in the Top Warp to Middle Warp COUNT Ratio is an integer |
| 0.1 | to | 10 | 5 | Top Shute to Middle Shute COUNT Ratio |
| 1 | to | 10 | | 5a: The numerator in the Top Warp to Middle Shute COUNT Ratio is an integer |
| 1 | to | 10 | | 5b: The denominator in the Top Warp to Middle Shute COUNT Ratio is an integer |
| | | | 6 | Top to Middle Wire Diameter Ratio: |
| 0.2 | to | 5 | | 6a: Constant Ratio for all cloth |
| | | | | 6b: Ratio Calculated |
| 0.1 | to | 10 | 7 | Middle to Bottom Warp COUNT Ratio |
| 1 | to | 10 | | 7a: The numerator in the Middle Warp to Bottom Warp COUNT Ratio is an integer |
| 1 | to | 10 | | 7b: The denominator in the Middle Warp to Bottom Warp COUNT Ratio is an integer |
| 0.1 | to | 10 | 8 | Middle to Bottom Shute COUNT Ratio |
| 1 | to | 10 | | 8a: The numerator in the Middle Warp to Bottom Shute COUNT Ratio is an integer |
| 1 | to | 10 | | 8b: The denominator in the Middle Warp to Bottom Shute COUNT Ratio is an integer |
| | | | 9 | Middle to Bottom Wire Diameter Ratio |
| 0.2 | to | 5 | | 9a: Constant Ratio for all cloth |
| | | | | 9b: Ratio Calculated |

FIG. 8A

| Screen | Top Warp Opening in Microns | Wire Diameter Multiplier | Top Aspect Ratio | Warp: Top to Middle COUNT Ratios | Shute: Top to Middle COUNT Ratios | TMDR Value | Warp: Middle to Bottom COUNT Ratios | Shute: Middle to Bottom COUNT Ratios | MBDR Value |
|---|---|---|---|---|---|---|---|---|---|
| 1 | 195.301 | 0.4292 | 1.0000 | 1.4918 | 2.5278 | 0.7021 | 2.0333 | 1.2000 | 0.6267 |
| 2 | 165.329 | 0.3841 | 1.0000 | 1.5000 | 2.5227 | 0.6944 | 2.4667 | 1.4667 | 0.4800 |
| 3 | 137.637 | 0.3875 | 1.0000 | 1.4944 | 2.5094 | 0.7000 | 2.9667 | 1.7667 | 0.4000 |
| 4 | 115.039 | 0.3974 | 1.0000 | 1.5048 | 2.5079 | 0.6923 | 3.5000 | 2.1000 | 0.3467 |
| 5 | 97.729 | 0.3899 | 1.0000 | 1.4960 | 2.4933 | 0.7143 | 4.1667 | 2.5000 | 0.2800 |
| 6 | 79.869 | 0.4134 | 1.0000 | 1.5000 | 2.5000 | 0.6842 | 5.0000 | 3.0000 | 0.2533 |

FIG. 8B

| Screen | Top Warp Count | Top Shute Count | Top Diameter (inches) | Middle Warp Count | Middle Shute Count | Middle Diameter (inches) | Bottom Warp Count | Bottom Shute Count | Bottom Diameter (inches) |
|---|---|---|---|---|---|---|---|---|---|
| 1 | 91.0 | 91.0 | 0.0033 | 61.0 | 36.0 | 0.0047 | 30.0 | 30.0 | 0.0075 |
| 2 | 111.0 | 111.0 | 0.0025 | 74.0 | 44.0 | 0.0036 | 30.0 | 30.0 | 0.0075 |
| 3 | 133.0 | 133.0 | 0.0021 | 89.0 | 53.0 | 0.0030 | 30.0 | 30.0 | 0.0075 |
| 4 | 158.0 | 158.0 | 0.0018 | 105.0 | 63.0 | 0.0026 | 30.0 | 30.0 | 0.0075 |
| 5 | 187.0 | 187.0 | 0.0015 | 125.0 | 75.0 | 0.0021 | 30.0 | 30.0 | 0.0075 |
| 6 | 225.0 | 225.0 | 0.0013 | 150.0 | 90.0 | 0.0019 | 30.0 | 30.0 | 0.0075 |

SHALE SHAKER SCREENS WITH ALIGNED WIRES

BACKGROUND OF THE INVENTION

1. Field of the Invention

The present invention is directed to screens for shale shakers and vibratory separators, and, in certain particular aspects, to screens with aligned wires.

2. Description of Related Art

Vibratory separators are used in a wide variety of industries to separate materials such as liquids from solids or solids from solids. In the oil and gas industries, shale shakers use screens to treat drilling fluid contaminated with undesirable solids. Typically such apparatuses have a basket, deck, or other screen holding or mounting structure mounted in or over a receiving receptacle or tank and vibrating apparatus for vibrating one or more screens. Material to be treated is introduced to the screen(s) either by flowing it directly onto the screen(s) or by flowing it into a container, tank, or "possum belly" from which it then flows to the screen(s).

In a variety of prior art screens, screen mesh or screen cloth as manufactured has a plurality of initially substantially square or rectangular openings defined by intersecting wires of the screen; i.e., as made a first plurality of substantially parallel wires extending in one general direction are perpendicular to a second plurality of substantially parallel wires, all the wires defining square or rectangular openings. In placing one such screen mesh or cloth on top of another, it can happen accidentally that wires of one layer are aligned with wires of another layer; but no effort is made to insure that a large portion, a majority, or substantially all wires of one layer are aligned with wires of another layer. In many actual uses, misalignment of wires occurs, resulting in the deformation of desired openings between wires and, therefore, in reduced screen effectiveness, reduced efficiency, and premature screen failure.

There has long been a need, recognized by the present inventors, for effective screens for shakers and separators. There has long been a need, recognized by the present inventors, for such screens with a substantial portion of aligned wires.

BRIEF SUMMARY OF THE INVENTION

The present invention discloses, in certain aspects, screening assemblies for shale shakers or other vibratory separators which have a plurality of screen wires in each of multiple screen mesh and/or screen cloth layers which are substantially aligned—wires in one layer aligned with wires in another layer according to preselected parameters. In certain aspects wires in such screening assemblies remain aligned during use. The present invention discloses, in certain aspects, a screen for a vibratory separator, or shale shaker, having at least two layers of screening material; the at least two layers of screening material including a first layer and a second layer, the first layer made of a plurality of intersecting first wires, the second layer made of a plurality of intersecting second wires, the first layer above the second layer; the first wires including first shute wires and first warp wires, each of the first shute wires at an angle to first warp wires; the second wires including second shute wires and second warp wires, each of the second shute wires at an angle to second warp wires; each of a plurality of the first warp wires aligned with a corresponding second warp wire according to a preselected wire count ratio, and each of a plurality of the first shute wires aligned with a corresponding second shute wire according to a preselected wire count ratio.

In certain particular aspects, wire alignment in such screen assemblies with multiple screening layers is facilitated by using screen meshes or cloths with a selected number of wires per inch in each layer, particularly with a ratio of number of wires in adjacent layers which is a ratio of two numbers which are either exact integers or are almost exact integers; e.g., in certain aspects, within ±0.1 of an integer.

In other aspects of screen assemblies according to the present invention, wires are aligned either one on top of the other vertically or wires are aligned in a line at an angle to the horizontal plane of a screen assembly; and, in one particular aspect, wires in multiple screen layers are aligned along a line which is coincident with a force vector imparted to the screen assembly by vibrating apparatus of the shaker or separator.

In certain particular aspects, in methods for making a multi-layer screen according to the present invention, multiple layers are carefully stacked together so that wires in different layers are aligned and then, optionally, the layers are connected together (welded, glued, epoxied, adhered, sintered, etc.) to maintain this alignment in subsequent manufacturing steps.

A vibratory separator or shale shaker, in one embodiment according to the present invention is, according to the present invention, provided with one, two, three or more screens as described herein according to the present invention. The present invention, in certain embodiments, includes a vibratory separator or shale shaker with a base or frame; a "basket" or screen mounting apparatus on or in the base or frame; one, two, three or more screens according to the present invention with wires aligned according to the present invention; vibrating apparatus; and a collection tank or receptacle. In one particular aspect, such a shale shaker treats drilling fluid contaminated with solids, e.g. cuttings, debris, etc.

Accordingly, the present invention includes features and advantages which are believed to enable it to advance vibrated screen technology. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, nonobvious screens for vibratory separators and shale shakers and methods for using them to separate components of material to be treated thereby; in one aspect, systems for shale shakers for treating drilling fluid with solids therein; and Such separators and shakers with one, two, three or more useful, unique, efficient, and nonobvious screens according to the present invention with wires in one screen layer aligned with wires in another screen layer.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3H is a top view of a middle layer of the screen of FIG. 3A.

FIG. 3I is an end cross-section view of the layer of FIG. 3H.

FIG. 3J is a side cross-section view of the layer of FIG. 3H.

FIG. 3K is a top view of a bottom layer of the screen of FIG. 3A.

FIG. 3L is an end cross-section view of the layer of FIG. 3K.

FIG. 4H is a top view of a middle layer of the screen of FIG. 4A.

FIG. 4I is an end cross-section view of the layer of FIG. 4H.

FIG. 4J is a side cross-section view of the layer of FIG. 4H.

FIG. 4K is a top view of a bottom layer of the screen of FIG. 4A.

FIG. 4L is an end cross-section view of the layer of FIG. 4K.

FIG. 5A is a top view of a screen according to the present invention.

FIG. 5B is an enlarged top view of part of the screen of FIG. 5A.

FIG. 5C is an enlarged top view of the center of the screen of FIG. 5A.

FIG. 5D is a cross-section view along line 5D-5D of FIG. 5A.

FIG. 5E is a cross-section view along line 5E-5E of FIG. 5A.

FIG. 5F is a top view of a top layer of the screen of FIG. 5A.

FIG. 5G is an end cross-section view of the layer of FIG. 5F.

FIG. 5H is a top view of a middle layer of the screen of FIG. 5A.

FIG. 5I is an end cross-section view of the layer of FIG. 5H.

FIG. 5J is a side cross-section view of the layer of FIG. 5H.

FIG. 5K is a top view of a bottom layer of the screen of FIG. 5A.

FIG. 5L is an end cross-section view of the layer of FIG. 5K.

FIG. 6B is an enlarged top view of part of the screen of FIG. 6A.

FIG. 6F is a top view of a top layer of the screen of FIG. 6A.

FIG. 6G is an end cross-section view of the layer of FIG. 6F.

FIG. 6H is a top view of a middle layer of the screen of FIG. 6A.

FIG. 6I is an end cross-section view of the layer of FIG. 6H.

FIG. 6J is a side cross-section view of the layer of FIG. 6H.

FIG. 6K is a top view of a bottom layer of the screen of FIG. 6A.

FIG. 6L is an end cross-section view of the layer of FIG. 6K.

FIG. 8 illustrates steps in a method according to the present invention.

FIG. 8A is a chart with information regarding certain screens according to the present invention.

FIG. 8B is a chart with additional information regarding the screens of FIG. 8A.

Figure 1A:
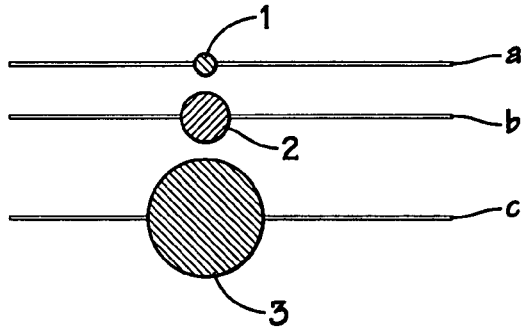
FIG. 1A is a schematic side cross-section view of a screen (shown partially) according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 1B:
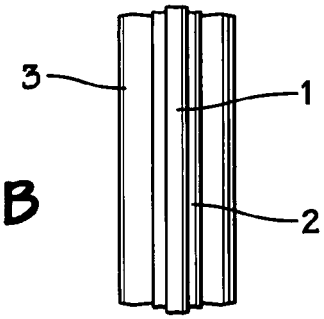
FIG. 1B is a top view of the screen of FIG. 1A showing three wires therein.

FIGS. 1A-2D illustrate the definition of "aligned wires." As shown in FIGS. 1A and 1B, wires 1, 2, 3 in multiple screening material layers a, b, c, respectively are aligned with each other vertically. As viewed from above (FIG. 1B) the wires 1, 2, 3 are in line vertically (at a ninety degree angle to the planes of the screen layers) and, as shown in FIG. 1B, parallel to each other.

Figure 1C:
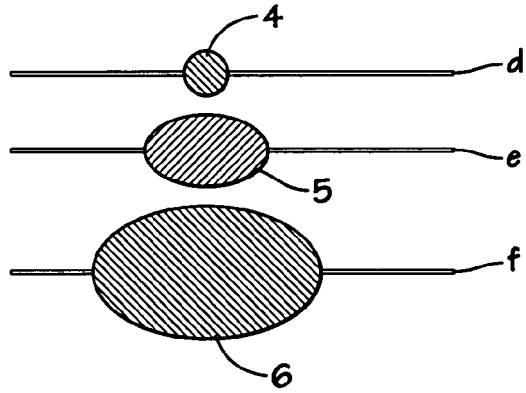
FIG. 1C is a schematic side cross-section view of a screen (shown partially) according to the present invention.

It is within the scope of the present invention to provide a screen assembly with a layer or layers of screen cloth in which wires have a non-round cross-section (whether such a layer is used in a screen or screen assembly without wires aligned or with wires aligned according to the present invention). FIG. 1C shows part of a screen assembly according to the present invention with screen cloth layers d, e. f with aligned wires 4, 5, 6, respectively. Wires 5 and 6 have non-round (oval) cross-sections.

Figure 1D:
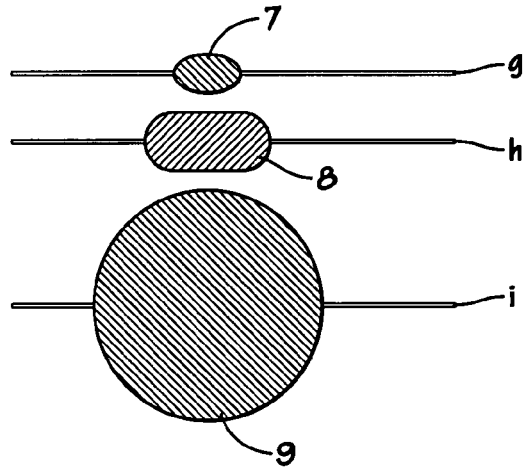
FIG. 1D is a schematic side cross-section view of a screen (shown partially) according to the present invention.

FIG. 1D shows a portion of a screen according to the present invention with screen cloth layers g, h, i with aligned wires 7, 8, 9, respectively. Wires 7 (oval) and 8 (rectangle with rounded corners) have non-round cross-sections.

Figure 2A:
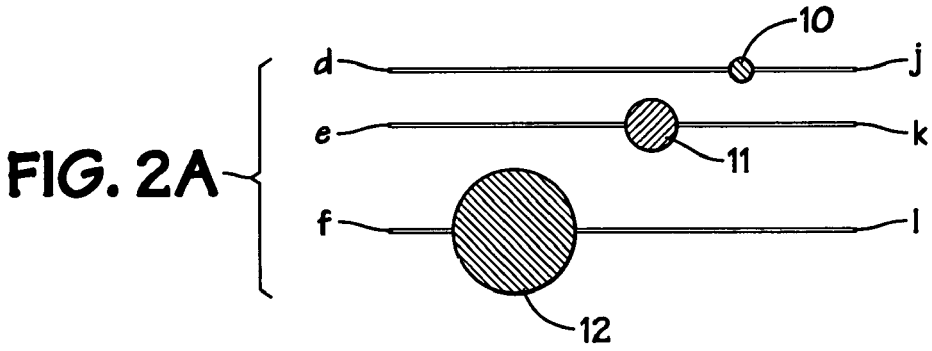
FIG. 2A is a schematic side cross-section view of a screen (shown partially) according to the present invention.
Figure 2B:
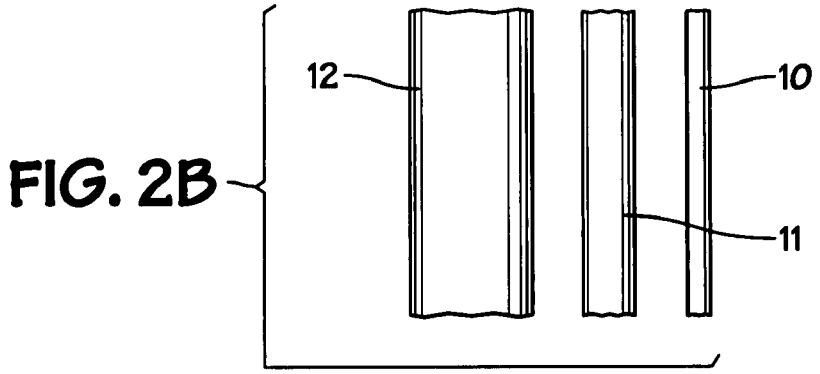
FIG. 2B is a top view of the screen of FIG. 2A showing three wires therein.

As shown in FIGS. 2A and 2B the wires 10, 11, 12 of screening material layers d, e, f, respectively are aligned with each other on a line that is at an angle to the plane of the screen layers (the plane of a screen assembly with such layers; e.g. as shown at an angle at about 45 degrees to the screen assembly plane). As viewed along this line the three wires 10, 11, 12 would appear as in the view of the wires 1, 2, 3 in FIG. 1B. It is desirable that the wires (e.g., 1, 2, 3 or 10, 11, 12) are parallel along their entire lengths.

Figure 2C:
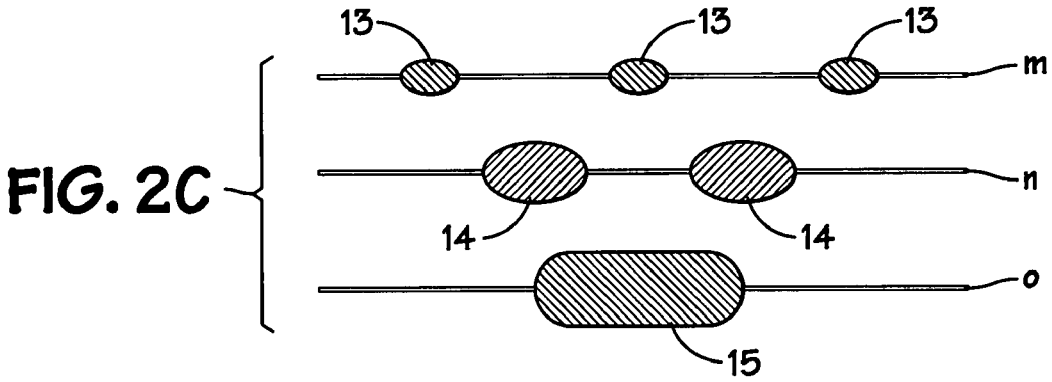
FIG. 2C is a schematic view of a screen (shown partially) according to the present invention.

FIG. 2C shows a screen with layers m, n, o with aligned wires 13 (oval), 14 (oval), and 15 (rectangle with rounded corners), respectively, with non-round cross-sections.

Figure 2D:
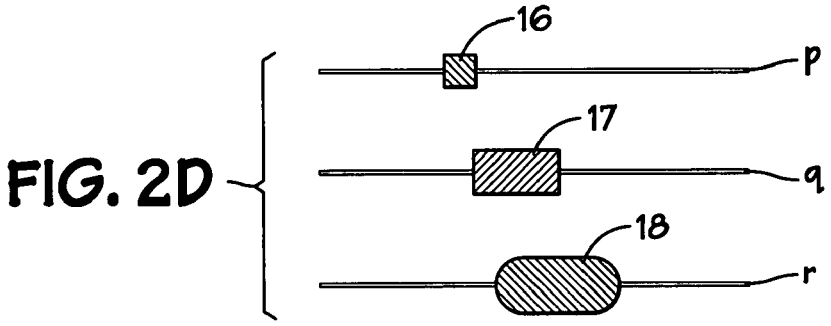
FIG. 2D is a schematic view of a screen (shown partially) according to the present invention.

FIG. 2D shows a screen with layers p, q, r with aligned wires 16 (square), 17 (rectangular) and 18 (rectangle with rounded corners), respectively with non-round cross-sections.

FIGS. 1A-2D are illustrative and are meant to show how wires in a particular screen or screen assembly are in alignment, or substantially all the wires are aligned, or the majority of wires in the entire screen layers depicted are aligned.

Figure 1E:
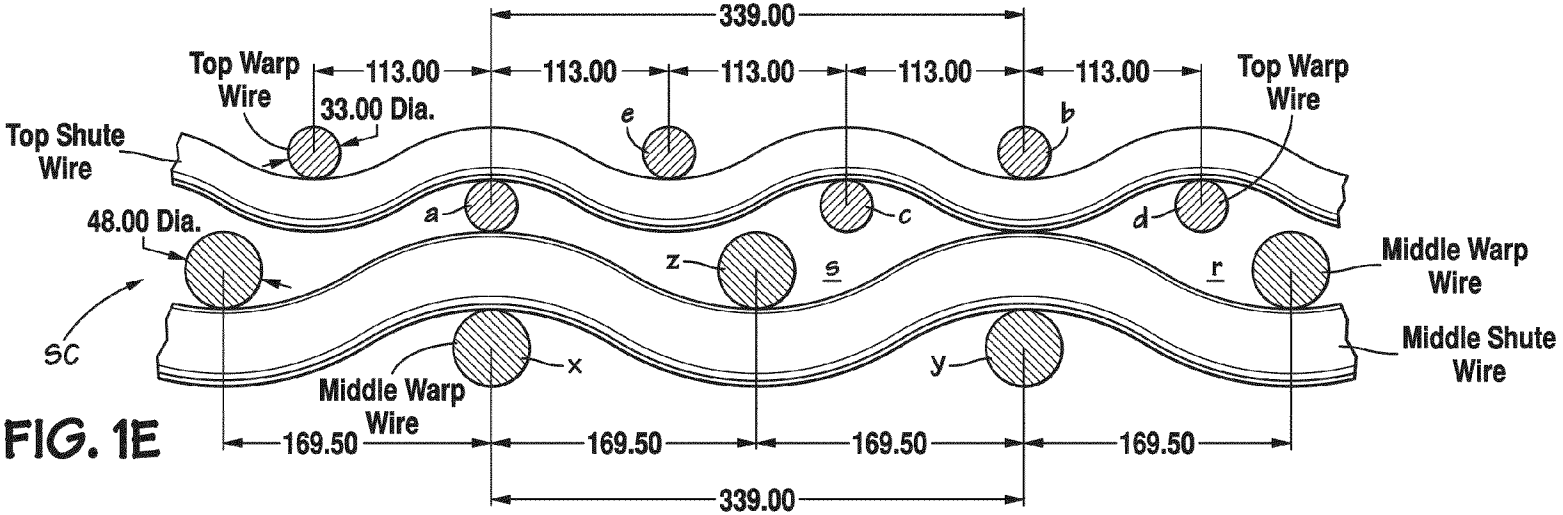
FIG. 1E is a cross-section view of a screen according to the present invention.
Figure 1F:
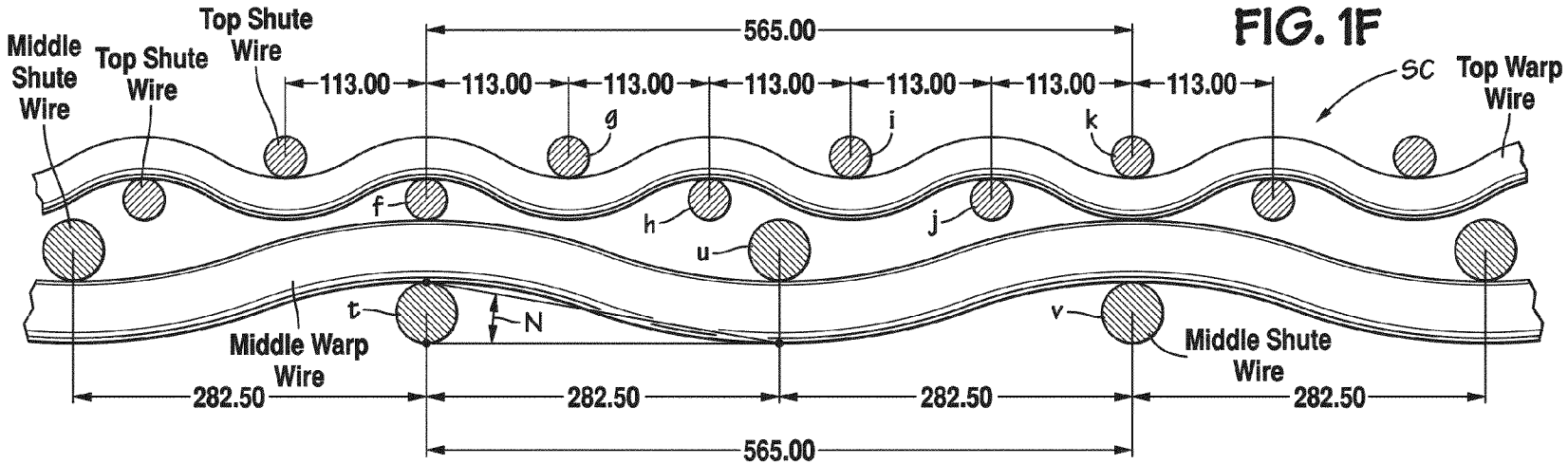
FIG. 1F is a cross-section view of the screen of FIG. 1E at an angle to the view of FIG. 1E.

FIGS. 1E and 1F illustrate two layers of screening material of a screen SC according to the present invention with aligned wires. In FIG. 1E the shute wires of both layers extend left-to-right and the warp wires, shown as circles, go into/out of the page. In FIG. 1F, the warp wires are shown as extending left-to-right and the shute wires, shown as circles, go into/out of the page. A weaving angle for the top layer is 16.3 degrees; a weaving angle for the bottom layer is 9.7 degrees. Angle N in FIG. 1F illustrates a weaving angle.

For the specific layers shown in FIGS. 1E and 1F, the numerical measurements indicated are in microns, e.g. "113" indicates 113 microns.

As shown in FIG. 1E wires a and b of the top layer are perfectly aligned with wires x and y of the lower layer. Also, wire c of the top layer can move toward the lower layer into a space s adjacent a wire z of the lower layer and a wire d can nest in a space r. In effect, wires x "masks" wire a and wire y "masks" wire b so that the screen SC has relatively more open areas than if the wires a and b were offset from the wires x, y, (respectively).

A ratio of wires spanning 339 microns of the screen SC as viewed in FIG. 1E (ratio of top warp wires to lower warp wires) is 3:2 (one half wire a plus wire e plus wire c plus one half wire b—or three wires—above two wires, one half wire x, plus wire y, plus one half wire z—or two wires). As shown in FIG. 1E, which has a wire count ratio of 3:2 for the top and middle warp wires, then, perfect alignment occurs if every third warp wire on the top layer aligns with every second warp wire of the layer below (as is shown in FIG. 1E)—i.e., two out of five wires are aligned or 40% alignment is achieved in one direction. In certain aspects of embodiments of the present invention, wires in one layer are aligned with wires in another layer according to the chosen wire count ratio (chosen according to the present invention). Thus with a top to middle wire count ratio of 5:2 in one direction, e.g., for the top and middle warp wires, every fifth warp wire of the top layer aligns with every second warp wire of the layer below—i.e., two out of seven wires are aligned or alignment of 28.5% is achieved in one direction. Thus, according to the present invention, wires are "aligned" when wire count ratios are as selected according to the present invention.

A ratio of wires spanning 565 microns of the screen SC as viewed in FIG. 1F (ratio of top shute wires to lower shute wires) is 5:2. (The top layer has square openings; the lower layer has rectangular openings.)

As shown in FIG. 1F wires f and k of the top layer are perfectly aligned with wires t and v of the lower layer.

Figure 3A:
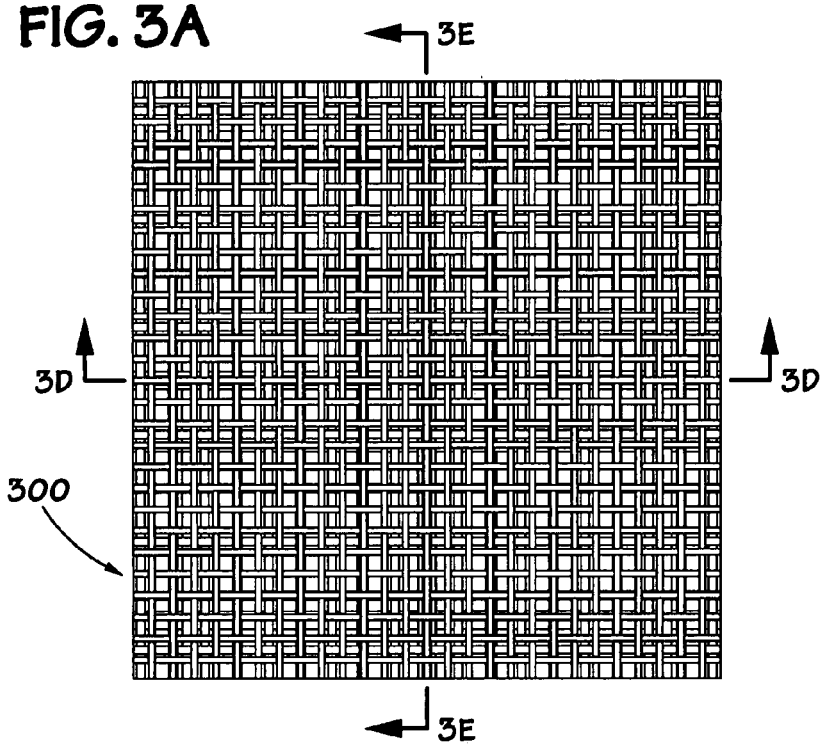
FIG. 3A is a top view of a screen according to the present invention.
Figure 3C:
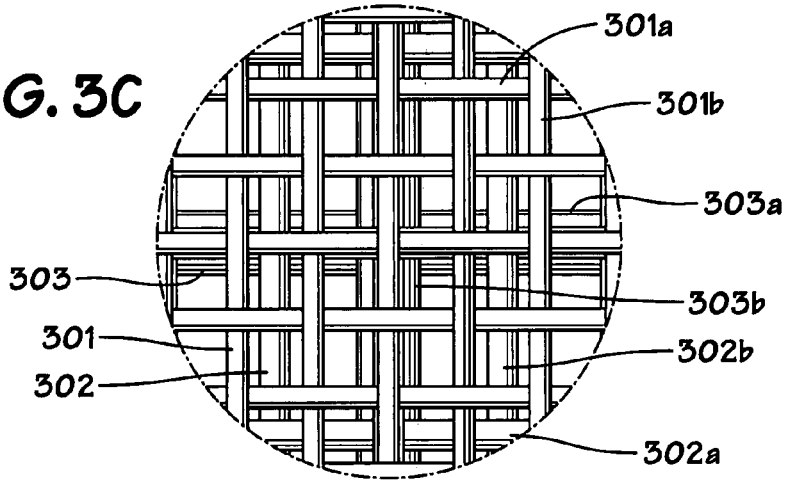
FIG. 3C is an enlarged top view of the center of the screen of FIG. 3A.
Figure 3D:
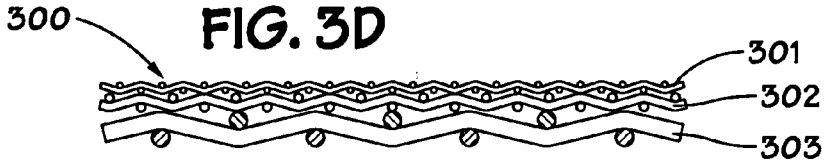
FIG. 3D is a cross-section view along line 3D-3D of FIG. 3A.
Figure 3E:
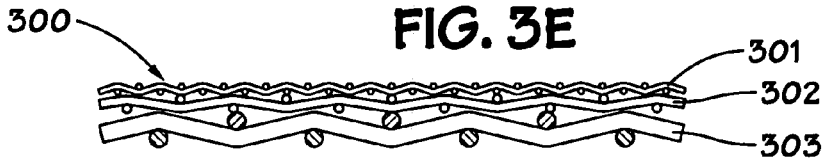
FIG. 3E is a cross-section view along line 3E-3E of FIG. 3A.
Figure 3B:
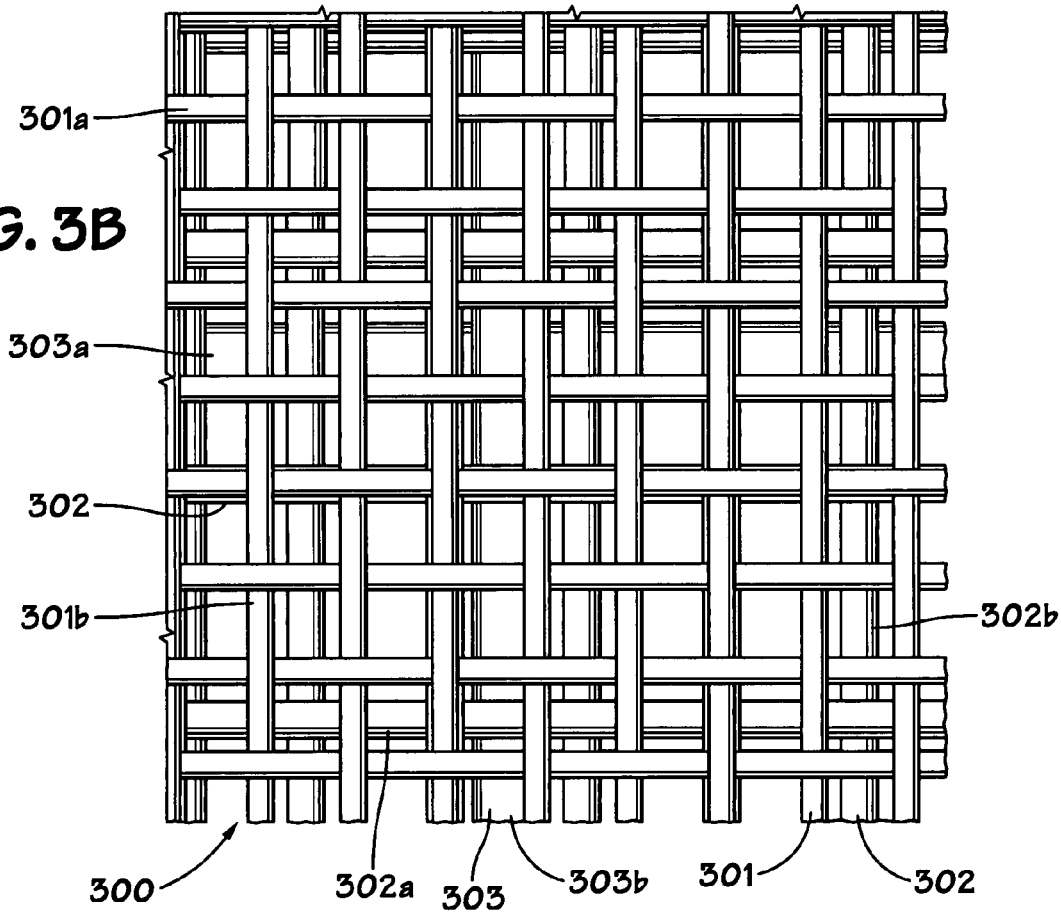
FIG. 3B is an enlarged top view of part of the screen of FIG. 3A.
Figure 3F:
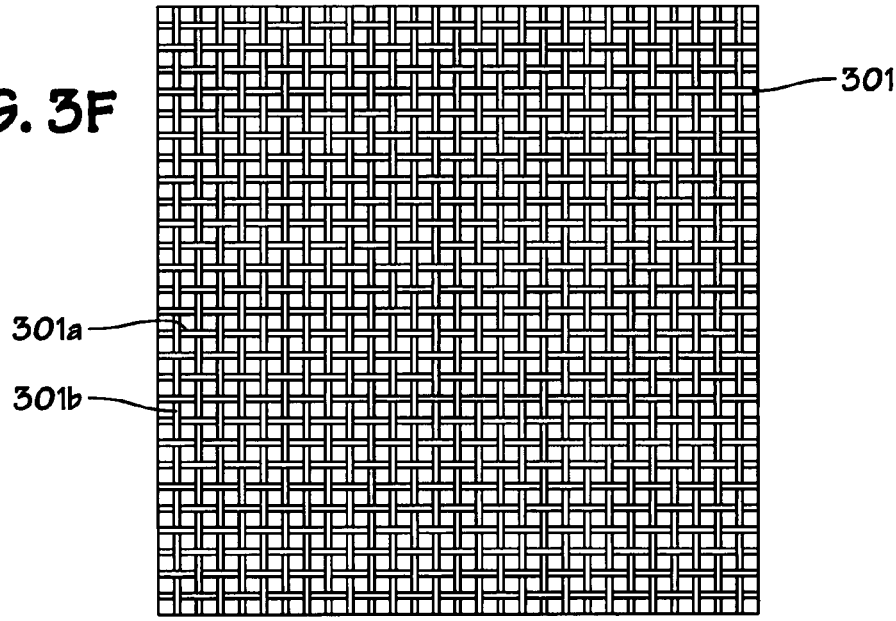
FIG. 3F is a top view of a top layer of the screen of FIG. 3A.
Figure 3G:
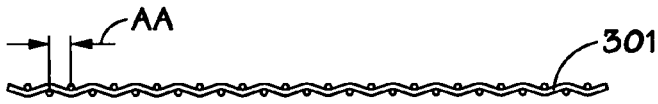
FIG. 3G is an end cross-section view of the layer of FIG. 3F.

FIGS. 3A-3L show a screen 300 according to the present invention and parts of it. The screen 300 has multiple mesh layers 301 (top), 302 (middle) and 303 (bottom). As shown in FIGS. 3B and 3C, the wires of each layer are aligned with the wires of the other two layers.

In one particular embodiment of a screen 300, the layer 301 has warp wires 301*a* and shute wires 301*b*; the layer 302 has warp wires 302*a* and shute wires 302*b*; and the layer 303 has warp wires 303*a* and shute wires 303*b*. The number of each of these types of wires per inch, wire diameters, and spacings AA, BB, CC, DD, as viewed from above, are as follows:

| | No./inch | Diameter (inches) | Spacing (inches) |
|---|---|---|---|
| 301a | 111 | .00250 | .0090 |
| 301b | 111 | .00250 | .0090 |
| 302a | 74 | .00360 | .0135 |
| 302b | 44 | .00360 | .0227 |
| 303a | 30 | .00750 | .0333 |
| 303b | 30 | .00750 | .0333 |

Figure 4A:
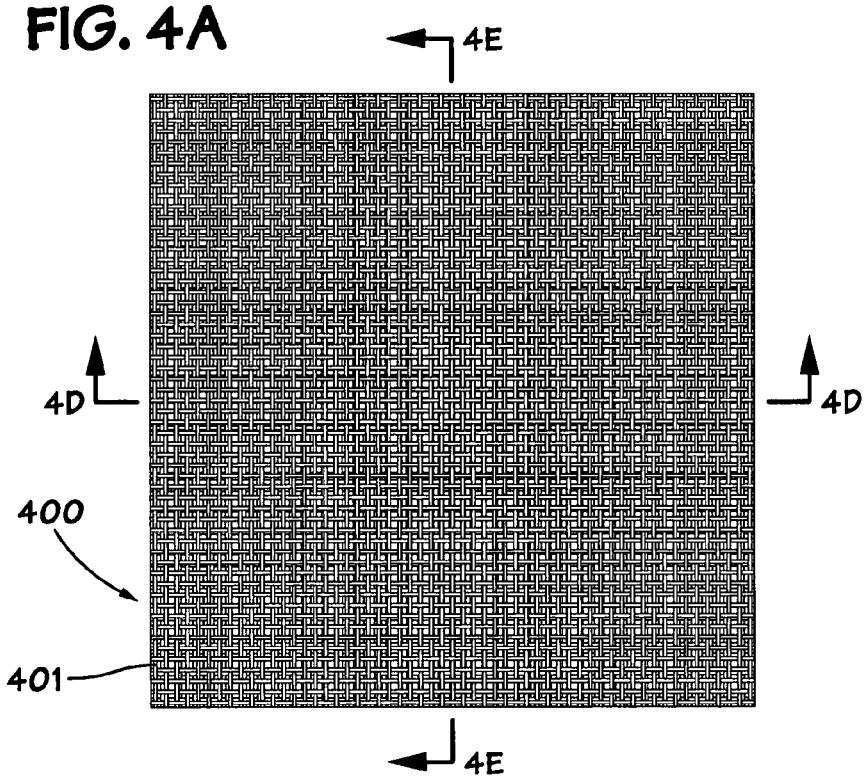
FIG. 4A is a top view of a screen according to the present invention.
Figure 4C:
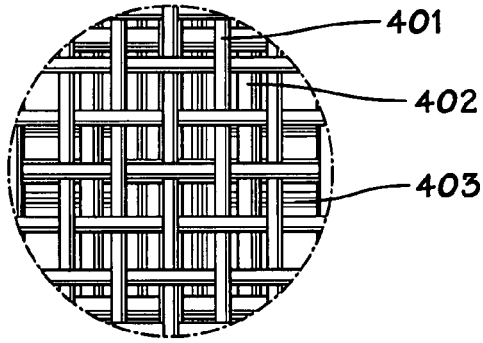
FIG. 4C is an enlarged top view of the center of the screen of FIG. 4A.
Figure 4D:
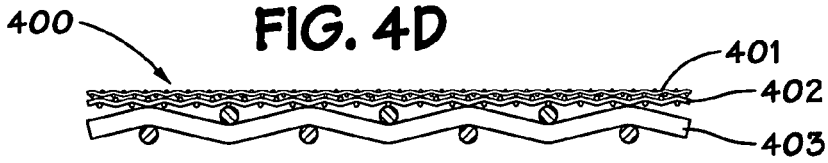
FIG. 4D is a cross-section view along line 4D-4D of FIG. 4A.
Figure 4E:
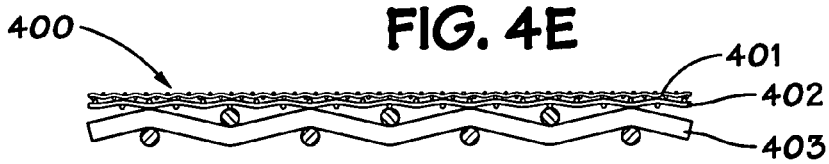
FIG. 4E is a cross-section view along line 4E-4E of FIG. 4A.
Figure 4B:
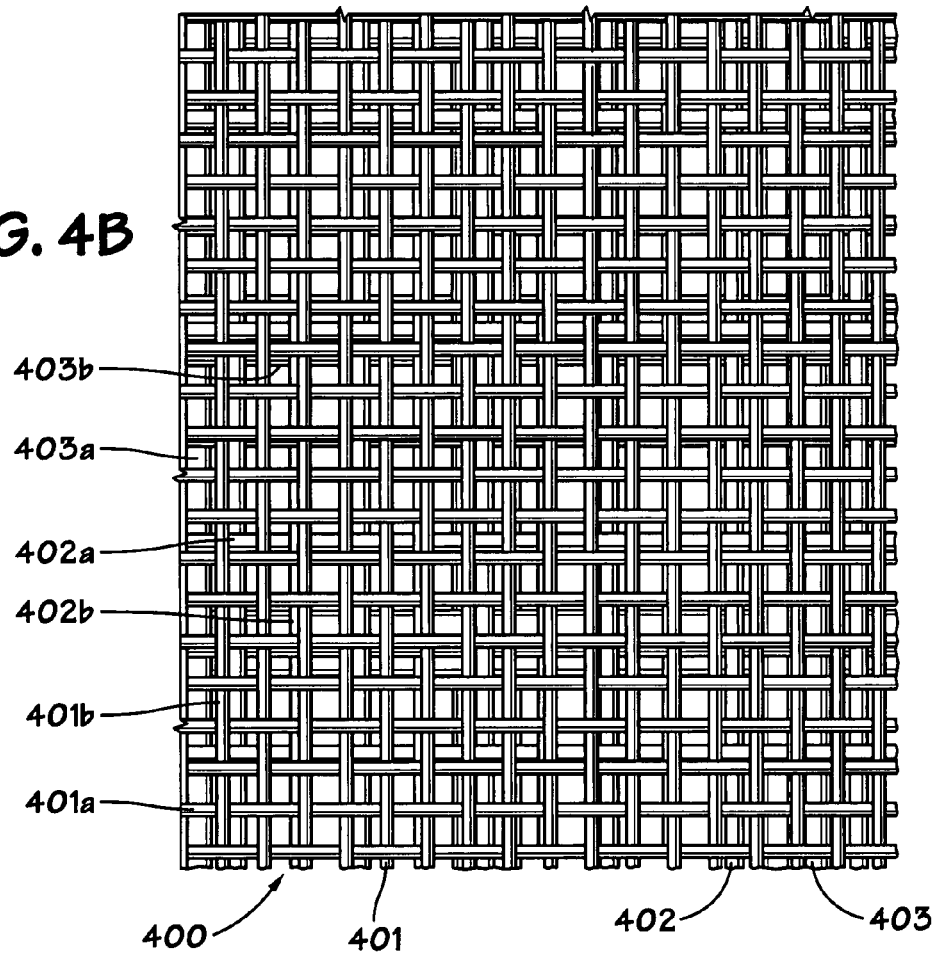
FIG. 4B is an enlarged top view of part of the screen of FIG. 4A.
Figure 4F:
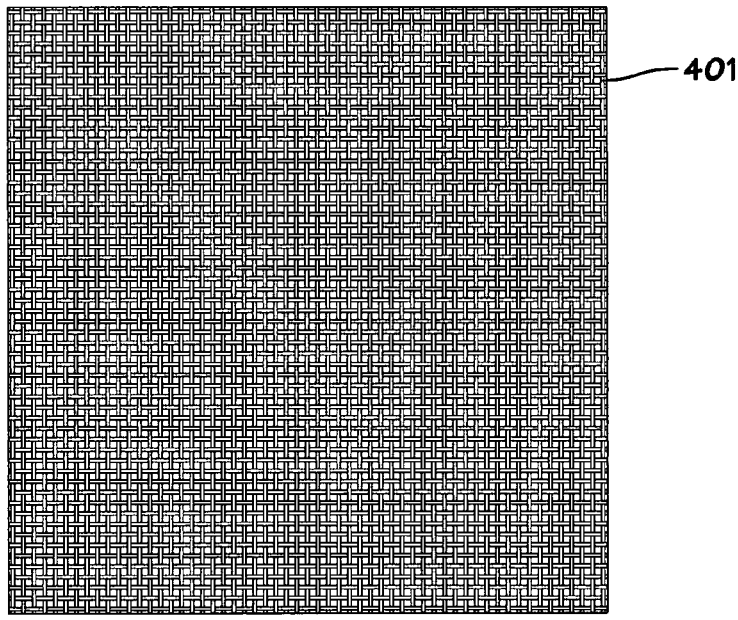
FIG. 4F is a top view of a top layer of the screen of FIG. 4A.
Figure 4G:
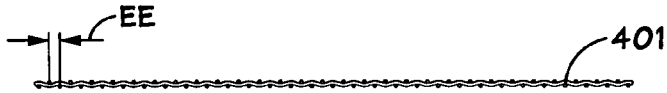
FIG. 4G is an end cross-section view of the layer of FIG. 4F.

FIGS. 4A-4L show a screen 400 according to the present invention and parts of it. The screen 400 has multiple mesh layers 401 (top), 402 (middle) and 403 (bottom). As shown in FIGS. 4B and 4C, the wires of each layer are aligned with the wires of the other two layers.

In one particular embodiment of a screen 400, the layer 401 has warp wires 401*a* and shute wires 401*b*; the layer 402 has warp wires 402*a* and shute wires 402*b*; and the layer 403 has warp wires 403*a* and shute wires 403*b* (warp wires across from left/right or right/left, FIG. 4B; shute wires intersect warp wires—as is also true for FIGS. 3B, 5B, and 6B). The number of each of these wires per inch, wire diameters, and the wire spacings EE, FF, GG, HH (as viewed from above) are as follows:

| | No./inch | Diameter (inches) | Spacing (inches) |
|---|---|---|---|
| 401a | 225 | .00130 | .0044 |
| 401b | 225 | .00130 | .0044 |
| 402a | 150 | .00190 | .0067 |
| 402b | 90 | .00190 | .0011 |
| 403a | 30 | .00750 | .0333 |
| 403b | 30 | .00750 | .0333 |

FIGS. 5A-5L show a screen 500 according to the present invention and parts of it. The screen 500 has multiple mesh layers 501 (top), 502 (middle) and 503 (bottom). As shown in FIGS. 5B and 5C, the wires of each layer are aligned with the wires of the other two layers.

In one particular embodiment of a screen 500, the layer 501 has warp wires 501*a* and shute wires 501*b*; the layer 502 has warp wires 502*a* and shute wires 502*b*; and the layer 503 has warp wires 503*a* and shute wires 503*b*. The number of each of these wires per inch, wire diameters, and the wire spacings II, JJ, KK, LL (as viewed from above) are as follows:

| | No./inch | Diameter (inches) | Spacing (inches) |
|---|---|---|---|
| 501a | 90 | .00300 | .0044 |
| 501b | 90 | .00300 | .0044 |
| 502a | 60 | .00370 | .0067 |
| 502b | 45 | .00370 | .0011 |
| 503a | 30 | .00750 | .0333 |
| 503b | 30 | .00750 | .0333 |

Figure 6A:
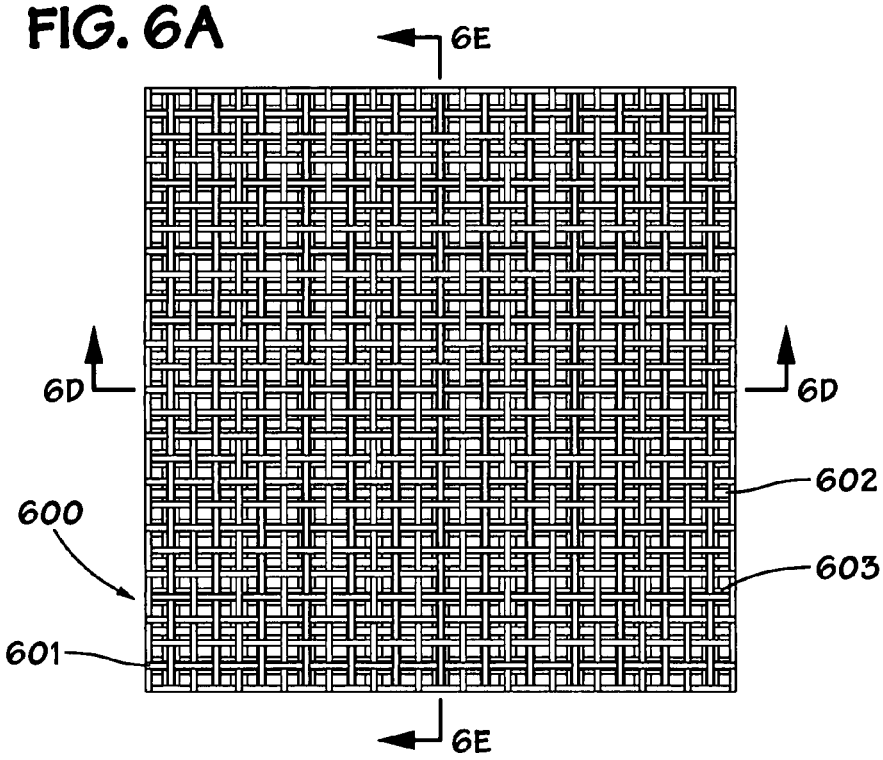
FIG. 6A is a top view of a screen according to the present invention.
Figure 6C:
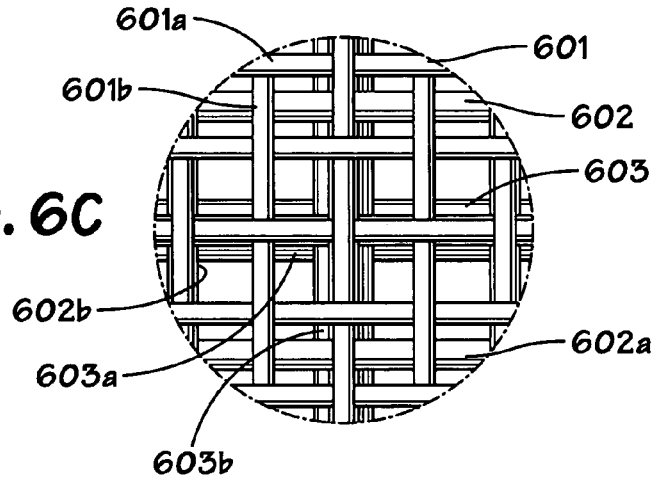
FIG. 6C is an enlarged top view of the center of the screen of FIG. 6A.
Figure 6D:
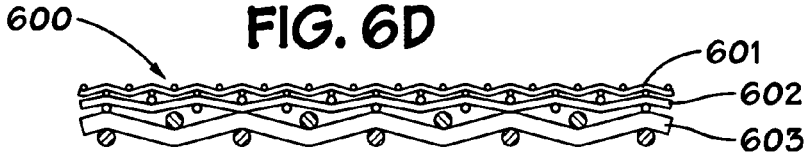
FIG. 6D is a cross-section view along line 6D-6D of FIG. 6A.
Figure 6E:
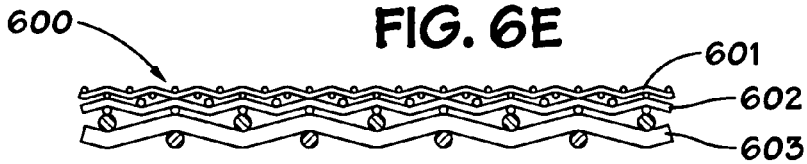
FIG. 6E is a cross-section view along line 6E-6E of FIG. 6A.

FIGS. 6A-6L show a screen 600 according to the present invention and parts of it. The screen 600 has multiple mesh layers 601 (top), 602 (middle) and 603 (bottom). As shown in FIGS. 6B and 6C, the wires of each layer are aligned with the wires of the other two layers.

In one particular embodiment of a screen 600, the layer 601 has warp wires 601*a* and shute wires 601*b*; the layer 602 has warp wires 602*a* and shute wires 602*b*; and the layer 603 has warp wires 603*a* and shute wires 603*b*. The number of each of these wires per inch, wire diameters, and the wire spacings MM, NN, OO, PP (as viewed from above) are as follows:

| | No./inch | Diameter (inches) | Spacing (inches) |
|---|---|---|---|
| 601a | 105 | .00250 | .0095 |
| 601b | 105 | .00250 | .0095 |
| 602a | 70 | .00350 | .0191 |
| 602b | 52.5 | .00350 | .0143 |
| 603a | 35 | .00700 | .0286 |
| 603b | 35 | .00700 | .0286 |

In certain aspects a screen according to the present invention (e.g., but not limited to, the screens of FIGS. 3A-7A) are made with multiple layers of screen cloth that are stacked one on top of the other. Ideally each piece of screen cloth as received from the manufacturer has well-defined openings between wires across its entire surface. According to the present invention, to insure that initially the wires of one layer line up with the wires of another layer and remain in this position during the making of a screen or screen assembly, two, three or more layers (however many are to be in the final screen or screen assembly), are carefully positioned one with respect to the other with wires aligned and then they are connected or secured together to hold them in position for further processing. In one aspect, the multiple layers are glued together with one or more amounts of hot melt glue or a line of hot melt glue is applied along one edge of the layers and allowed to set. Alternatively any suitable known glue, epoxy, adhesive or connector(s) (e.g. but not limited to staples, rivets, clips, etc.) may be used.

Figure 7A:
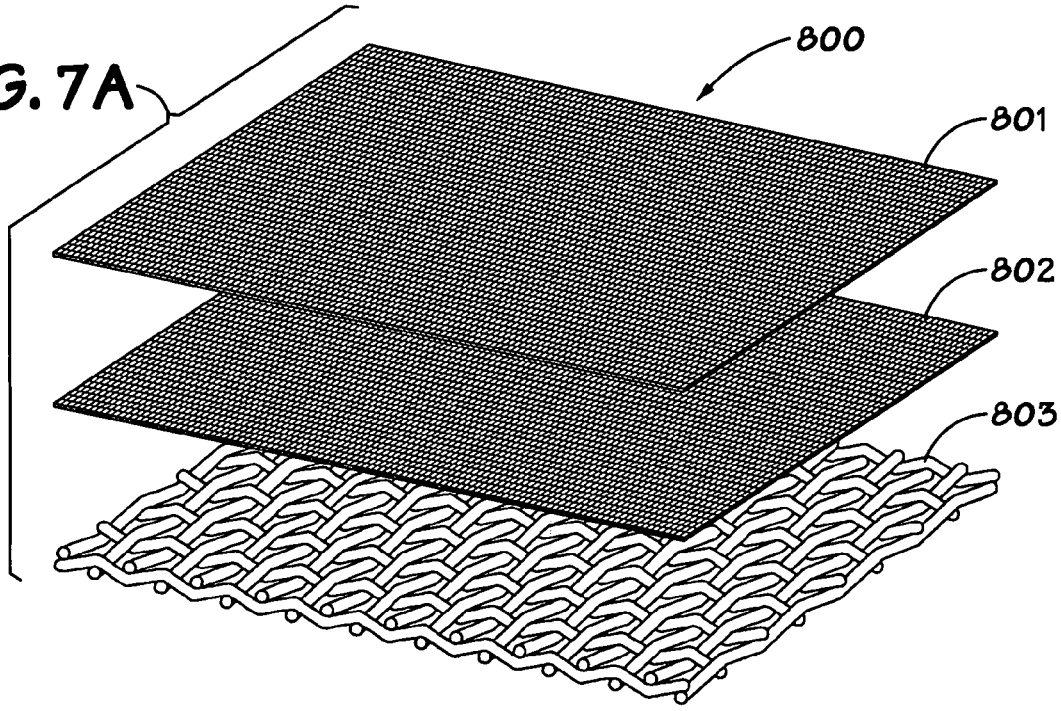
FIG. 7A is a perspective view of three layers of a screen according to the present invention.
Figure 7B:
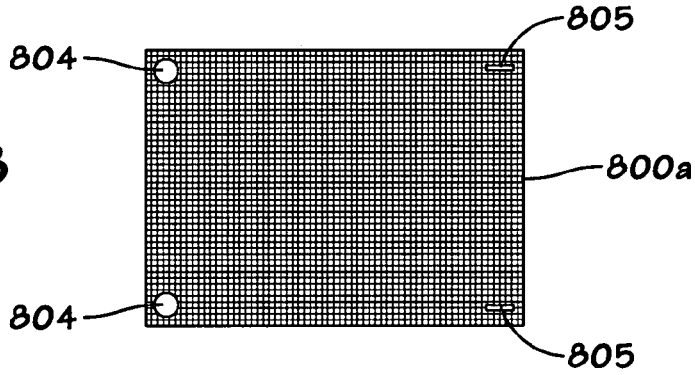
FIG. 7B is a top view of a screen according to the present invention made with the layers of FIG. 7A.

FIG. 7A shows a step in a method according to the present invention in which multiple layers of screen cloth 801, 802, 803 (three shown) are stacked together for a multi-layer screen 800. The layers are positioned so that wires in each layer align with wires in the other layers. As shown for a screen 800*a* with layers 801-803 in FIG. 7B, two amounts of adhesive 804 adhere the three layers together to maintain their relative position and the alignment of the wires. One, two, three, four or more amounts of adhesive (e.g. glue, hot melt glue, epoxy, adhesive, cement, plastic, thermoplastic) may be used.

Figure 7C:
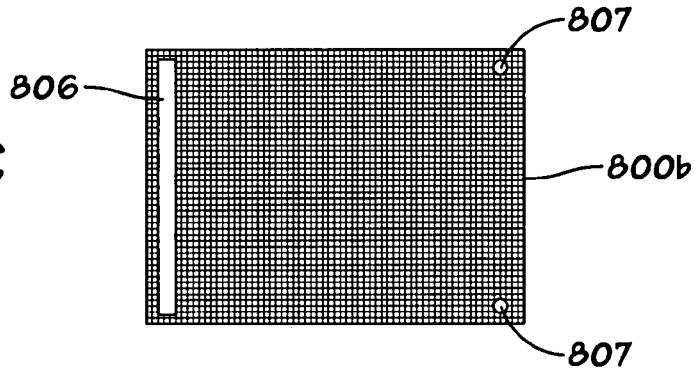
FIG. 7C is top view of a screen according to the present invention.

Optionally, or in addition to the amounts of adhesive 803, a staple or staples 805 may be used (or a rivet or rivets 807, as in FIG. 7C). Any suitable connector may be used (staple, rivet, clip, screw.

As show in FIG. 7C in a screen 800*b* with layers 801-803, a line of adhesive (e.g., but not limited to, a line 806 of hot melt glue) is applied to the layers 801-803 to connect them together. In any embodiment of the present invention an adhesive and/or a connector can be applied manually or by a machine.

In any embodiment of a multi-layer screen according to the present invention, the layers may be unconnected to each other or any two adjacent or all layers may be connected together.

In any screen according to the present invention with multiple layers, all layers can have wires of the same diameter or wires in each layer can be of different diameters.

In certain aspects placing one layer selected according to the present invention on top of another layer selected according to the present invention in combination results in desired alignment (e.g. before the combination of a panel having multiple openings with mesh layers) and/or the force of fluid and/or vibratory force contributes to this alignment. It is within the scope of the present invention by selecting wire screen layers as described above (any embodiment) with wire count ratios according to the present invention to achieve a substantial amount of wire alignment between wires of layers of screening material; e.g., in certain aspects, in a multi-layer screen according to the present invention, to achieve such alignment of at least 30%; of at least 50%; or, in some cases, at least 70%. The percentage of aligned wires in one direction achieved according to the present invention is based on the wire count ratio for that direction.

FIG. 8 illustrates one method according to the present invention for selecting layers of wire screening material for a screen according to the present invention having aligned wires according to the present invention. The method includes steps 1 to 9.

In step 1 a basis point is selected for the top layer of the screen—which determines whether it will be fine or coarse. In one aspect, a screen mesh can be selected with a top warp opening in microns between 25 to 500 microns.

Once the top warp opening size of the top layer is selected, a wire diameter for wires in the top layer is determined by multiplying the selected top warp opening size by a multiplier, e.g. between 0.1 to 1.1 (based on experience and desirable resulting wire diameters). In one particular aspect, no result finer than 0.0010 inches is used (step 2*a*).

In step 3 an aspect ratio is selected (in one aspect, in step 3*a*, between 0.25 to 4.00) with 1.0 being the aspect ratio for a square opening. Alternatively, in step 3*b*, a top layer warp weaving angle is selected, e.g. between 5 and 45 degrees.

At the end of step 3, the top layer's warp opening, wire diameter, and aspect ratio are determined.

Steps 4-6 deal with the middle layer of a three layer screen. In step 4 a count ratio is selected, the count ratio between the top warp wires (per unit length) and the middle warp wires (per unit length), with the numerator and denominator in each ratio being an integer or nearly an integer (e.g. within ±0.1 of an integer); in one aspect, with the integers between 1 and 10 and with the resulting count ratio being 0.1 to 10. Step 4, therefore, yields the warp count for the middle layer.

In step 5, the shute count for the middle layer is determined in a manner similar to that of step 4 for warp count.

In step 6, the diameter of the wires of the middle layer is determined by using step 6*a* or step 6*b*. In step 6*a* a constant ratio is chosen (based on experience) of top layer wire diameter to middle layer wire diameter, e.g. in a range between 0.2 to 5; or, in step 6*b*, a wire diameter is calculated based on results from step 1 (e.g. using a simple formula function based on the numerical result of step 1).

Steps 7-9 deal with the lowermost bottom layer of a three layer screen. In step 7 the lowermost layers warp count is determined (e.g. as in step 4, above for the middle layer), in one aspect, with integers ranging between 1 and 10. In step 8, the lowermost layer's shut count ratio is determined (e.g. as in step 5, above, for the middle layer). In step 9, the diameter of the wires of the lowermost layer is determined (e.g. as in step 6, above, for the middle layer).

FIGS. 8A and 8B show values, measurements, and ratios for screens 1-6 according to the present invention determined with the method of FIG. 8. "TMDR Value" is top-to-middle diameter ratio. "MBDR Value" is middle-to-bottom diameter ratio.

The present invention, therefore, provides in at least certain embodiments, a screen for a vibratory separator, the screen having at least two layers of screening material, the at least two layers of screening material including a first layer and a second layer, the first layer made of a plurality of intersecting first wires, the second layer made of a plurality of intersecting second wires, the first layer above the second layer, the first wires including first shute wires and first warp wires, each of the first shute wires at an angle to first warp wires, the second wires including second shute wires and second warp wires, each of the second shute wires at an angle to second warp wires, each of a plurality of the first warp wires aligned with a corresponding second warp wire according to a preselected wire count ratio, and each of a plurality of the first shute wires aligned with a corresponding second shute wire according to a preselected wire count ratio. Such a screen may have one or some, in any possible combination, of the following: wherein at least twenty, thirty, forty, fifty, sixty, seventy or eighty percent of wires in one direction of the first layer and of the second layer are aligned; wherein the vibratory separator is a shale shaker for use on a drilling rig; wherein the at least two layers of screening material includes a third layer, the third layer below the second layer and made of a plurality of intersecting third wires, the third wires including third shute wires and third warp wires, each of the third shute wires at an angle to third warp wires, each of a plurality of the first warp wires aligned with a corresponding third warp wire, and each of a plurality of the first shute wires aligned with a corresponding third shute wire; each of a plurality of the second warp wires aligned with a corresponding third warp wire, each of a plurality of the second shute wires each aligned with a corresponding third shute wire; wherein the first layer having a warp-to-shute wire count ratio A between 0.9 and 1.1, a wire count ratio B in a first direction between the first layer and the second layer is between 1.25:1 and 1.75:1, and a wire count ratio C in a second direction different than the first direction between the top layer and the second layer is between 2.25 and 2.75; wherein the ratio A is 1:1, the ratio B is 1.5:1, and the ratio C is 2.5:1; wherein wires in the first layer range in diameter in inches between 0.0011 and 0.0055, wires in the second layer range in diameter in inches between 0.0011 and 0.0055, and a ratio of diameters of wires of the first layer to diameters of wires in the second layer ranges between 0.72 and 0.68; and/or wherein the first layer and the second layer are calendared together.

The present invention, therefore, provides in at least certain embodiments, a screen for a vibratory separator, the screen having at least two layers of screening material; the at least two layers of screening material including a first layer and a second layer, the first layer made of a plurality of intersecting first wires, the second layer made of a plurality of intersecting second wires, the first layer above the second layer; the first wires including first shute wires and first warp wires, each of the first shute wires at an angle to first warp wires; the second wires including second shute wires and second warp wires, each of the second shute wires at an angle to second warp wires; each of a plurality of the first warp wires aligned with a second warp wire, and each of a plurality of the first shute wires aligned with a second shute wire; the first layer having a warp-to-shute wire count ratio A between 0.9 and 1.1; a wire count ratio B in a first direction between the first layer and the second layer is between 1.25:1 and 1.75:1; and a wire count ratio C in a second direction different than the first direction between the top layer and the second layer is between 2.25 and 2.75; wherein the ratio A is 1:1, the ratio B is 1.5:1, and the ratio C is 2.5:1; wherein wires in the first layer range in diameter in inches between 0.0011 and 0.0055, wires in the second layer range in diameter in inches between 0.0011 and 0.0055, and a ratio of wire diameter of wires of the first layer to wire diameter of wires in the second layer ranges between 0.72 and 0.68; and/or wherein the first layer and the second layer are calendared together.

The present invention, therefore, provides in at least certain embodiments, a method for treating material with a vibratory separator, the method including introducing material for treatment to a vibratory separator having a screen for screening the material, the material having at least two components, the screen comprising at least two layers of screening material, the at least two layers of screening material including a first layer and a second layer, the first layer made of a plurality of intersecting first wires, the second layer made of a plurality of intersecting second wires, the first layer above the second layer, the first wires including first shute wires and first warp wires, each of the first shute wires at an angle to first warp wires, the second wires including second shute wires and second warp wires, each of the second shute wires at an angle to second warp wires, each of a plurality of the first warp wires aligned with a corresponding second warp wire according to a preselected wire count ratio, and each of a plurality of the first shute wires aligned with a corresponding second shute wire according to a preselected wire count ratio; and screening out at least one component of the material with the screen. Such a method may be for material which is drilling fluid with solids therein and the vibratory separator may be a shale shaker.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A screen assembly for a vibratory separator, comprising:

a first layer of screening material comprising a plurality of first warp wires and a plurality of first shute wires intersecting each of said plurality of first warp wires at an angle; and a second layer of screening material comprising a plurality of second warp wires and a plurality of second shute wires intersecting each of said plurality of second warp wires at an angle, wherein each of a first number of said first warp wires is aligned with a corresponding one of said second warp wires at a predetermined angle relative to a plane of said screen assembly, each of a second number of said first shute wires is aligned with a corresponding one of said second shute wires at said predetermined angle, said first number of said first warp wires aligned with said corresponding second warp wires is based on a first preselected wire count ratio, and said second number of said first shute wires aligned with said corresponding second shute wires is based on a second preselected wire count ratio.

2. The screen assembly of claim 1, wherein said predetermined angle is substantially perpendicular to said plane of said screen assembly.

3. The screen assembly of claim 1, wherein said predetermined angle is substantially aligned with a force vector imparted to said screen assembly by said vibratory separator.

4. The screen assembly of claim 1, wherein at least one of said first and second preselected wire count ratios is preselected such that at least 30% of said first and second warp wires or at least 30% of said first and second shute wires are aligned at said predetermined angle.

5. The screen assembly of claim 1, wherein at least one of said first and second preselected wire count ratios is preselected such that at least 50% of said first and second warp wires or at least 50% of said first and second shute wires are aligned at said predetermined angle.

6. The screen assembly of claim 1, wherein at least one of said first and second preselected wire count ratios is preselected such that at least 70% of said first and second warp wires or at least 70% of said first and second shute wires are aligned at said predetermined angle.

7. The screen assembly of claim 1, further comprising a third layer of screening material comprising a plurality of third warp wires and a plurality of third shute wires intersecting each of said plurality of third warp wires at an angle, wherein each of a third number of said first warp wires is aligned with a corresponding one of said third warp wires at said predetermined angle, each of a fourth number of said first shute wires is aligned with a corresponding one of said third shute wires at said predetermined angle, said third number of said first warp wires aligned with said corresponding third warp wires is based on a third preselected wire count ratio, and said fourth number of said first shute wires aligned with said corresponding third shute wires is based on a fourth preselected wire count ratio.

8. The screen assembly of claim 7, wherein each of a fifth number of said second warp wires is aligned with a corresponding one of said third warp wires at said predetermined angle, a sixth number of said second shute wires is aligned with a corresponding one of said third shute wires at said predetermined angle, said fifth number of said second warp wires aligned with said corresponding third warp wires is based on a fifth preselected wire count ratio, and said sixth number of said third shute wires aligned with said corresponding third shute wires is based on a sixth preselected wire count ratio.

9. The screen assembly of claim 1, wherein said warp-to-shute wire count ratio of said first layer of screening material is between 0.9:1 and 1.1:1, said first preselected wire count ratio is between 1.25:1 and 1.75:1, and said second preselected wire count ratio is between 2.25:1 and 2.75:1.

10. The screen assembly of claim 9, wherein said warp-to-shute wire count ratio of said first layer of screening material is approximately 1:1, said first preselected wire count ratio is approximately 1.5:1, and said second preselected wire count ratio is approximately 2.5:1.

11. The screen assembly of claim 1, wherein wires of said first and second layers of screening material each have a diameter ranging from 0.0011 inches to 0.0055 inches, and a diameter ratio of wires of said first layer to wires of said second layer ranges from 0.68 to 0.72.

12. The screen assembly of claim 1, wherein said first and second layers of screening material are calendared together.

13. A screen assembly for a vibratory separator, comprising:

a first layer of screening material comprising a plurality of first warp wires and a plurality of first shute wires intersecting each of said plurality of first warp wires at an angle, wherein a warp-to-shute wire count ratio of said first warp and first shute wires is between 1 to 0.9 and 1 to 1.1, and a diameter of each of said first warp and first shute wires ranges between 0.0011 inches and 0.0055 inches; and a second layer of screening material comprising a plurality of second warp wires and a plurality of second shute wires intersecting each of said plurality of second warp wires at an angle, wherein a diameter of each of said first warp and first shute wires ranges between 0.0011 inches and 0.0055 inches, a diameter ratio of wires comprising said first layer to wires comprising said second layer ranges from 0.68 to 0.72, each of a first number of said first warp wires is aligned with a corresponding one of said second warp wires at a predetermined angle relative to a plane of said screen assembly, a each of a second number of said first shute wires is aligned with a corresponding one of said second shute wires at said predetermined angle, said first number of said first warp wires aligned with said corresponding second warp wires is based on a first preselected wire count ratio between 1.25:1 and 1.75:1, and said second number of said first shute wires aligned with said corresponding second shute wires is based on a second preselected wire count ratio between 2.25:1 and 2.75:1.

14. The screen assembly of claim 13, wherein said warp-to-shute wire count ratio of said first layer of screening material is approximately 1:1, said first preselected wire count ratio is approximately 1.5:1, and said second preselected wire count ratio is approximately 2.5:1.

15. The screen assembly of claim 13, wherein said first and second layers of screening material are calendared together.

16. A method for treating material with a vibratory separator, comprising:

introducing a material for treatment comprising two or more material components to a vibratory separator comprising a screen assembly for screening said material for treatment, said screen assembly comprising a first layer of screening material comprising a plurality of first warp wires and a plurality of first shute wires intersecting each of said plurality of first warp wires at an angle and a second layer of screening material comprising a plurality of second warp wires and a plurality of second shute wires intersecting each of said plurality of second warp wires at an angle, wherein each of a first number of said first warp wires is aligned with a corresponding one of said second warp wires at a predetermined angle relative to a plane of said screen assembly, each of a second number of said first shute wires is aligned with a corresponding one of said second shute wires at said predetermined angle, said first number of said first warp wires aligned with said corresponding second warp wires is based on a first preselected wire count ratio, and said second number of said first shute wires aligned with said corresponding second shute wires is based on a second preselected wire count ratio; and screening out at least one of said at least two or more material components from said material for treatment using said screen assembly.

17. The method of claim 16, wherein introducing a material for treatment comprising two or more material components to said vibratory separator comprises introducing drilling fluids comprising solids therein to a shale shaker.

* * * * *